US008828633B2

(12) United States Patent
Itabashi et al.

(10) Patent No.: US 8,828,633 B2
(45) Date of Patent: Sep. 9, 2014

(54) TONER

(75) Inventors: Hitoshi Itabashi, Yokohama (JP); Takashi Kenmoku, Mishima (JP); Harumi Takada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/973,739

(22) Filed: Dec. 20, 2010

(65) Prior Publication Data

US 2011/0159425 A1 Jun. 30, 2011

(30) Foreign Application Priority Data

Dec. 28, 2009 (JP) ..... 2009-297289

(51) Int. Cl.
*G03G 9/097* (2006.01)
*G03G 9/087* (2006.01)

(52) U.S. Cl.
CPC ..... *G03G 9/08791* (2013.01); *G03G 9/08722* (2013.01); *G03G 9/08706* (2013.01); *G03G 9/08726* (2013.01); *G03G 9/08708* (2013.01); *G03G 9/08724* (2013.01)
USPC ..... 430/108.4; 430/96; 430/97; 430/100; 430/101; 430/102; 430/103; 430/104; 430/105; 430/106.1; 430/106.2; 430/106.3; 430/107.1; 430/108.1; 430/108.2; 430/108.21; 430/108.22; 430/108.8; 430/109.1; 430/109.3; 430/109.31; 430/109.4; 430/109.5

(58) Field of Classification Search
USPC ..... 430/108.1, 108.4, 108.23, 109.1, 109.3, 430/109.4, 96, 97, 100–105, 106.1, 106.2, 430/106.3, 107, 1, 108.2, 108.21, 108.22, 430/108.8, 109.31, 109.5
See application file for complete search history.

(56) References Cited

U.S. PATENT DOCUMENTS 5,439,771 A 8/1995 Baba et al.
5,494,770 A 2/1996 Baba et al.
5,573,880 A 11/1996 Mayama et al.
5,576,133 A 11/1996 Baba et al.

(Continued)

FOREIGN PATENT DOCUMENTS

JP 62-187429 A 8/1987
JP 63-270060 A 11/1988

(Continued)

OTHER PUBLICATIONS

English Abstract of Japanese Patent Publication No. 03-105355.*

(Continued)

*Primary Examiner* — Christopher Rodee
*Assistant Examiner* — Omar Kekia
(74) *Attorney, Agent, or Firm* — Fitzpatrick, Cella, Harper and Scinto

(57) ABSTRACT

To obtain a toner which has excellent charge rise and stability, tends to have a sharp charge distribution, has excellent pigment dispersion properties, exhibits no disarray in an image even during a high-speed copying operation, and can stably output high-resolution images. A toner comprising toner particle containing a binder resin, a colorant, resin PA, and resin PB, wherein the resin PA has unit A represented by Formula (1), the resin PB has unit B represented by Formula (2), a content "a" of the unit A in the toner particle is 2.00 μmol/g or more, and a molar ratio b/a of the content "a" and a content "b" of the unit B in the toner particle is 0.10 or more and 10.00 or less.

2 Claims, 2 Drawing Sheets

(56) References Cited

U.S. PATENT DOCUMENTS

| | | | | |
|---|---|---|---|---|
| 5,744,278 | A | 4/1998 | Ayaki et al. | |
| 5,766,814 | A | 6/1998 | Baba et al. | |
| 5,985,502 | A | 11/1999 | Ayaki et al. | |
| 6,083,655 | A | 7/2000 | Itabashi et al. | |
| 6,106,990 | A | 8/2000 | Tazawa et al. | |
| 6,124,070 | A | 9/2000 | Baba et al. | |
| 6,165,663 | A | 12/2000 | Baba et al. | |
| 6,358,658 | B1 | 3/2002 | Tazawa et al. | |
| 6,500,593 | B2 | 12/2002 | Abe et al. | |
| 6,566,028 | B2 | 5/2003 | Tazawa et al. | |
| 6,689,525 | B2 | 2/2004 | Itabashi | |
| 6,777,153 | B2 | 8/2004 | Yano et al. | |
| 6,790,576 | B2 | 9/2004 | Fujimoto et al. | |
| 6,808,855 | B2 | 10/2004 | Ayaki et al. | |
| 6,808,907 | B2 | 10/2004 | Honma et al. | |
| 6,908,721 | B2 | 6/2005 | Kenmoku et al. | |
| 6,911,520 | B2 | 6/2005 | Fukui et al. | |
| 7,045,321 | B2 | 5/2006 | Imamura et al. | |
| 7,252,917 | B2 | 8/2007 | Ohno et al. | |
| 7,323,282 | B2 | 1/2008 | Ohno et al. | |
| 7,393,912 | B2 * | 7/2008 | Mihara et al. | 528/272 |
| 7,399,568 | B2 | 7/2008 | Fukui et al. | |
| 7,408,017 | B2 | 8/2008 | Imamura et al. | |
| 7,452,960 | B2 | 11/2008 | Yano et al. | |
| 7,510,813 | B2 | 3/2009 | Yano et al. | |
| 7,638,194 | B2 | 12/2009 | Fukui et al. | |
| 7,638,590 | B2 | 12/2009 | Fukui et al. | |
| 7,682,765 | B2 | 3/2010 | Sugawa et al. | |
| 7,795,363 | B2 | 9/2010 | Fukui et al. | |
| 2007/0111125 | A1 | 5/2007 | Tominaga et al. | |
| 2007/0275317 | A1 | 11/2007 | Fujimoto et al. | |
| 2008/0286675 | A1 | 11/2008 | Tani et al. | |
| 2009/0035688 | A1 | 2/2009 | Abe et al. | |
| 2009/0162773 | A1 | 6/2009 | Fukui et al. | |
| 2009/0202927 | A1 | 8/2009 | Yano et al. | |
| 2010/0119965 | A1 | 5/2010 | Tani et al. | |
| 2010/0233610 | A1 | 9/2010 | Fukui et al. | |
| 2010/0291482 | A1 | 11/2010 | Minami et al. | |

FOREIGN PATENT DOCUMENTS

| | | | |
|---|---|---|---|
| JP | 03-105355 | * | 2/1991 |
| JP | 03-105355 | * | 5/1991 |
| JP | 2694572 | B2 | 12/1997 |
| JP | 2807795 | B2 | 10/1998 |
| JP | 2003-96170 | A | 4/2003 |
| JP | 2003-215853 | A | 7/2003 |

OTHER PUBLICATIONS

Tirrell, et al., "Functional Polymers. VI.* Preparation and Polymerization of Methyl 3-Vinylsalicylate, Methyl 3-Vinylacetylsalicylate, 3-Vinylsalicylic Acid, and 3-Vinylacetylsalicylic Acid", Journal of Polymer Science: Polymer Chemistry Edition, vol. 18, No. 9, Sep. 1980, pp. 2755-2771.

Lee, et al., "Structure-activity relationships of semisynthetic mumbaistatin analogs", Bioorganic and Chemistry, vol. 15, 2007, pp. 5207-5218.

* cited by examiner

TONER

BACKGROUND OF THE INVENTION

1. Field of the Invention

The present invention relates to a toner for developing an electrostatic image by an image forming method such as electrophotography and electrostatic printing, or a toner for forming a toner image in a toner jet image forming method.

2. Description of the Related Art

Recently, due to demands for higher-speed and highly stable printers and copiers, faster charge control and charge characteristic that is less susceptible to environmental changes have been required. To control the charge characteristic of a toner, a charge control agent is added. Especially, due to reasons such as consideration of the environment, demands for a more stable charge characteristic, and production costs, the use of a resin (charge control resin) having a charge control function as a toner raw material has been proposed. Japanese Patent Nos. 2694572 and 2807795 propose a toner that contains a copolymer containing a salicylic acid group, and a toner that contains a styrene resin and a copolymer containing a sulfonic acid group as a charge control resin. Further, Japanese Patent Application Laid-Open Nos. 2003-96170 and 2003-215853 propose a PES charge control resin formed by polycondensation of a monomer containing a sulfonic acid (salt) as a resin having improved compatibility with a binder resin.

However, although toners such as those described above has good charge rise, deterioration in the toner development characteristic due to overcharging of the toner and unevenness in the toner charge distribution is a problem. Such a problem is especially noticeable after many sheets have been printed using the toner.

It is an object of the present invention to provide a toner which has excellent charge rise and charge stability, and which has a sharp charge distribution even after prolonged use.

SUMMARY OF THE INVENTION

The present invention relates to a toner comprising toner particle containing a binder resin, a colorant, resin PA, and resin PB, wherein the resin PA has unit A represented by Formula (1), the resin PB has unit B represented by Formula (2), a content "a" of the unit A in the toner particle is 2.00 μmol/g or more, and a molar ratio b/a of the content "a" and a content "b" of the unit B in the toner particle is 0.10 or more and 10.00 or less:

(1)

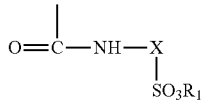

wherein, X represents an optionally substituted aliphatic group or an optionally substituted aromatic group, and $R_1$ is selected from hydrogen, an alkali metal, an alkyl group having 1 to 4 carbon atoms, or an aromatic group;

(2)

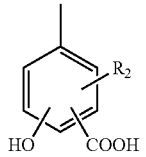

wherein, the COOH group and the OH group are bonded to the aromatic ring at adjacent positions, and $R_2$ is selected from hydrogen, an alkyl group having 1 to 4 carbon atoms, and an alkoxy group having 1 to 4 carbon atoms.

According to the present invention, a toner can be obtained which has excellent charge rise and charge stability, and which has a sharp charge distribution even after prolonged use.

Further features of the present invention will become apparent from the following description of exemplary embodiments with reference to the attached drawings.

DESCRIPTION OF THE EMBODIMENTS

Figure 1:
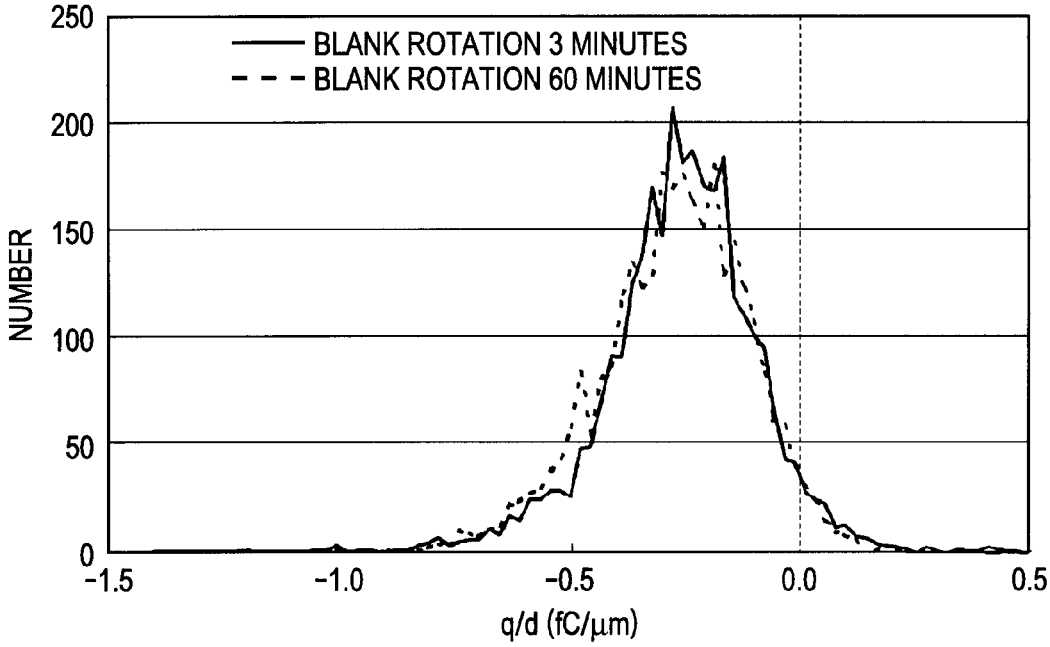
FIG. 1 is a graph illustrating changes in charge distribution, which serves as A rank evaluation criteria for evaluation of the toner charge distribution.

Preferred embodiments of the present invention will now be described in detail in accordance with the accompanying drawings.

The toner according to the present invention includes resin PA having unit A represented by the following Formula (1) and resin PB having unit B represented by the following Formula (2) in the toner particle.

(1)

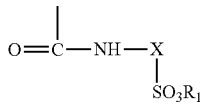

In the Formula (1), X represents an optionally substituted aliphatic group or an optionally substituted aromatic group, and $R_1$ is selected from hydrogen, an alkali metal, an alkyl group having 1 to 4 carbon atoms, or an aromatic group.

Further, in a more preferred embodiment of Formula (1), $R_1$ is hydrogen or an alkyl group having 1 to 4 carbon atoms, and X represents an optionally substituted alkylene structure having 1 or 2 carbon atoms or an optionally substituted aromatic ring. Examples of a substituent on the alkylene structure include a hydroxyl group, an alkyl group having 1 to 12 carbon atoms, an aryl group or an alkoxy group. Examples of a substituent on the aromatic ring include a hydroxyl group, an alkyl group having 1 to 12 carbon atoms, an aryl group or an alkoxy group. This substituent may also form a 5-membered or 6-membered aromatic ring including the adjacent carbon atom.

(2)

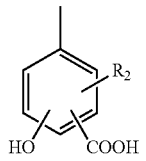

In the Formula (2), the COOH group and the OH group are bonded to the aromatic ring at adjacent positions, and $R_2$ is selected from hydrogen, an alkyl group having 1 to 4 carbon atoms, or an alkoxy group having 1 to 4 carbon atoms.

By making both the resin PA and the resin PB present in the toner binder, the toner has excellent charge rise and charge stability, and a sharp charge distribution. Although the reason for this is not clear, the present inventors consider as follows. Specifically, the charge rate increases and the charge rise of the toner improves due to the electrostatic charge generation mechanism of the sulfonic acid group in the unit A, and the charge accumulation mechanism of the amide group. Further, it is thought that due to the salicylic acid structure in the unit B, excess charge that has accumulated in the unit A dissipates in the toner binder, whereby over charging of the toner is suppressed. Based on this action, it is thought that even if there is unevenness in the opportunities for charging among each of the toner particles, the charge distribution of the whole toner tends to be uniform, and charge rise also improves.

The substituent X in the unit A represented by Formula (1) is an optionally substituted aliphatic group or aromatic group. The substituent X is preferably an aromatic group, since the charging performance of the sulfonic acid group improves. Most preferably, the substituent X is present on the ortho position adjacent to the amide group (refer to Formula (3)).

(3)

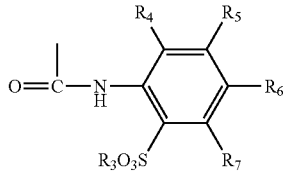

$R_3$ is a substituent selected from hydrogen, an alkyl group, and an alkali metal, $R_4$ to $R_7$ are independently a substituent selected from hydrogen, a hydroxyl group, an alkyl group having 1 to 4 carbon atoms, and an alkoxy group having 1 to 4 carbon atoms, and adjacent substituents may form a 5-membered or 6-membered aromatic ring.

On the other hand, the unit B represented by Formula (2) is an aromatic unit having a hydroxy group and a carboxyl group, and has a salicylic acid structure in which the hydroxy group and the carboxyl group are next to each other. The other substituents are a hydrogen atom or an alkyl group or alkoxy group having 1 or more and 4 or less carbon atoms.

In the present invention, the content "a" of the unit A in the toner particle needs to be 2.00 μmol/g or more. If the content a is less than 2.00 μmol/g, the desired charge amount may not be obtained for the toner, and charge rise may be slower. Further, in the present invention, the molar ratio b/a of the content "a" of the unit A and the content "b" of the unit B in the toner particle needs to be 0.10 or more and 10.00 or less. If the molar ratio b/a is less than 0.10, although the charge characteristic is good, pigment dispersibility can be poor. Further, if the molar ratio b/a is more than 10.00, charge uniformity is lost, which is not preferable. An example of a method for adjusting the content a is to prepare the resin PA with a fixed amount of unit A in advance, and mix the resin with the toner binder. The same method may be used to adjust the content "b".

In the present invention, the content "a" of the unit A in a toner particle is calculated as follows. Based on elemental analysis of the resin PA, the amount of sulfur (S) element derived from the unit A in 1 g of the resin PA is calculated. The content (mmol/g) of unit A per 1 g of the resin PA is calculated by dividing the amount of S element by 32.06 (atomic weight of S). Then, the content a is calculated from the content of unit A per 1 g of the resin PA and the amount of the resin PA included in the toner particle.

The content "b" of the unit B in a toner particle is calculated as follows. The amount of hydroxyl groups derived from the unit B in the resin PB is calculated by titrating the resin PB by the below-described method to quantify the hydroxyl value of the resin PB. Based on the calculated value, the content (mmol/g) of the unit B in the resin PB is calculated. Then, the content "b" is calculated from the content of the unit B per 1 g of the resin PB and the amount of the resin PB included in the toner particle. If the resin PB has a hydroxyl group at a site other than the unit B, the hydroxyl value of a compound (e.g., a polyester resin) is measured in advance immediately before carrying out an addition reaction of the unit B when producing the resin PB. The added amount of the unit B can be calculated based on the difference between with the hydroxyl value of the resin PB after the addition reaction.

A known resin composition may be used as the composition of the resin PA and the resin PB. More specifically, examples thereof include a vinyl polymerized resin such as a styrene acrylic resin, and a condensation polymerized resin such as a polyester and a polyether.

If the resin PA and the resin PB are vinyl polymerized resins, the resin PA and the resin PB can be produced by copolymerizing the vinyl monomer containing a unit A and a unit B with another vinyl monomer respectively. During this process, the contents "a" and "b" can be adjusted based on the copolymerization ratio of the vinyl monomers. However, if the radical polymerization reaction rates of the vinyl monomer containing a structure of unit A or a unit B and the other vinyl monomer are substantially different, it is preferred to take a measure to ensure that a uniform composition is obtained by adjusting the concentrations in the reaction system, such as by dropping the respective monomers during the reaction.

Polymerization initiators that can be used in the production of the vinyl polymerized resins are not especially limited, and a known peroxide polymerization initiators or azo polymerization initiators may be used. Further, examples of polymerization initiators that can be used during copolymerization of the vinyl monomers include peroxide polymerization initiators and azo polymerization initiators. Examples of organic peroxide polymerization initiators include peroxyesters, peroxydicarbonates, dialkylperoxides, peroxyketals, ketone peroxides, hydroperoxides, and diacylperoxides. Examples of the inorganic peroxide polymerization initiators include peroxyesters such as t-butyl peroxyacetate, t-butyl peroxypivalate, t-butyl peroxyisobutylate, t-hexyl peroxyacetate, t-hexyl peroxypivalate, t-hexyl peroxyisobutylate, t-butyl peroxyisopropyl monocarbonate, and t-butyl peroxy 2-ethylhexyl monocarbonate; diacylperoxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and t-butyl peroxyallyl monocarbonate. Examples of the azo polymerization initiators include 2,2'-azobis-(2,4-dimethylvaleronitrile), 2,2'-azobisisobutyronitrile, 1,1'-azobis-(cyclohexan-1-carbonitrile), 2,2'-azobis-4-methoxy-2,4-dimethylvaleronitrile, azobisisobutyronitrile, and dimethyl-2,2'-azobis-(2-methylpropionate).

A known vinyl monomer may be used as the vinyl monomer having the unit A structure. Specific examples thereof include 2-acrylamido-2-methylpropanesulfonic acid, 2-methacrylamido-2-methylpropanesulfonic acid, 2-acrylamido-2-methylpropane sulfonic acid methyl, 2-methacrylamido-2-methylpropane sulfonic acid methyl, 2-acrylamido-2-methylpropane sulfonic acid ethyl, 2-methacrylamido-2-methylpropane sulfonic acid ethyl, 2-acrylamido benzene sulfonic acid, 2-methacrylamido benzene sulfonic acid, 2-acrylamido benzene sulfonic acid methyl, 2-methacrylamido benzene sulfonic acid methyl, 2-acrylamido benzene sulfonic acid ethyl, 2-methacrylamido benzene sulfonic acid ethyl, 2-acrylamido-5-methoxy benzene sulfonic acid, 2-methacrylamido-5-methoxy benzene sulfonic acid, 2-(meth)acrylamido-5-methoxy benzene sulfonic acid methyl, 2-acrylamido-5-methoxy benzene sulfonic acid methyl, and 2-methacrylamido-5-methoxy benzene sulfonic acid ethyl.

Production examples of a vinyl monomer having the structure of unit A are shown below.

<Monomer 4A>

A reaction vessel equipped with a stirrer, a thermometer, and a nitrogen inlet tube was charged with 788 g of 2-amino-5-methoxybenzene sulfonic acid, 642 g of triethylamine, and 4 L of tetrahydrofuran, and then 352 g of methacrylic acid chloride was dropped at 5° C. or less for minutes. The mixture was stirred for 6 hours while maintaining the temperature at 5° C. or less. Then, still while maintaining the temperature at 5° C. or less, 800 ml of concentrated hydrochloric acid and 12.8 L of water were added into the reaction mixture to separate the mixture. The organic layer was washed with 6.4 L of 2% hydrochloric acid, then washed three times with 6.4 L of water. The obtained solution was concentrated under reduced pressure to obtain crystals. The obtained crystals were charged into a reaction vessel equipped with a stirrer, a condenser, a thermometer, and a nitrogen inlet tube, and then 1,680 g of trimethyl orthoformate and 1.5 g of p-benzoquinone were further charged thereto. The resultant mixture was reacted for 10 hours at 80° C. The reaction mixture was cooled, and concentrated under reduced pressure. The deposited crystals were filtered, then added into 5 L of water to disperse and wash, then filtered, and washed twice with 2.5 L of water. The obtained crystals were wind-dried at 30° C., then purified by column chromatography (5 kg of silica gel, mobile phase hexane:ethyl acetate=1/1), to obtain 383 g of the monomer 4A represented by Formula (4A).

(4A)

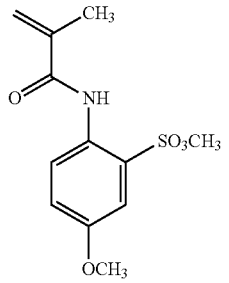

<Monomer 4B>

A reaction vessel equipped with a stirrer, a thermometer, and a nitrogen inlet tube was charged with 856 g of 2-nitrobenzenesulfonyl chloride and 7 L of methanol, and then a mixed solution of 745 g of 28% sodium methylate and 600 ml of methanol was dropped for 45 minutes at a temperature of 10° C. or less. The mixture was then stirred for 50 minutes while maintaining the temperature at 10° C. The reaction mixture was acidified by adding 1.6 kg of 0.1 mol/l hydrochloric acid, and then adding 3 L of water, whereby crystals deposited. The crystals were filtered, washed with 2 L of water, and then dried under reduced pressure for 10 hours at 30° C. to obtain 702 g of 2-nitrobenzene sulfonic acid methyl ester.

A reaction vessel equipped with a stirrer, a thermometer, and a nitrogen inlet tube was charged with 688 g of 2-nitrobenzene sulfonic acid methyl ester, 4.7 L of acetic acid, and 2.18 kg of $SnCl_2.2H_2O$, and the resultant mixture was cooled to 10° C. or less. Hydrochloric acid gas was bubbled through the mixture for 4 hours under stirring. Then, the mixture was stirred for 10 hours at 10° C. or less. Subsequently, 8.4 L of chloroform was added into the reaction mixture, and then while maintaining the temperature at 10° C. or less, the mixture was neutralized with aqueous 20% NaOH. The mixture was separated by further adding 56 L of water. The aqueous phase was extracted with 4 L of chloroform, and then the mixture including the chloroform layer was washed twice with 4 L of water, and separated. The mixture was dried by anhydrous magnesium sulfate, and then filtered to obtain 2-aminobenzene sulfonic acid methyl ester in chloroform solution. The obtained solution was charged along with 950 g of diethylaniline into a reaction vessel equipped with a stirrer, a thermometer, and a nitrogen inlet tube, and then 287 g of acrylic acid chloride was dropped for 15 minutes at a temperature of 5° C. or less. The mixture was stirred for 6 hours while maintaining the temperature at 5° C. or less. Then, 800 ml of concentrated hydrochloric acid and 12.8 L of water were added into the reaction mixture to separate the mixture. The organic layer was washed with, in order, 6.4 L of 2% hydrochloric acid, 6.4 L of water, 6.4 L of aqueous 3% sodium hydrogen carbonate, and 6.4 L of water. The product was dried by anhydrous magnesium sulfate, then filtered, and dried under reduced pressure at 30° C. to obtain 796 g of crystals. These were purified by column chromatography (5 kg silica gel, mobile phase hexane:ethyl acetate=2/1), to obtain 406 g of the monomer 4B represented by Formula (4B).

(4B)

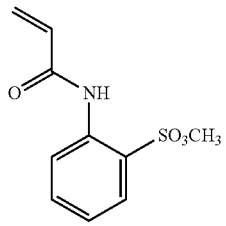

<Monomer 4C>

352 g of the monomer 4C represented by Formula (4C) was obtained by the same method as in the production of the monomer 4A, except that 726 g of p-toluidin-2-sulfonic acid was used instead of 2-amino-5-methoxybenzene sulfonic acid.

(4C)

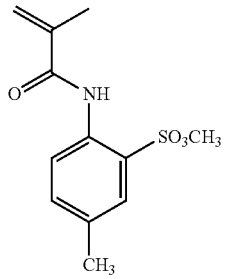

<Monomer 4D>

A reaction vessel equipped with a stirrer, a condenser, a thermometer, and a nitrogen inlet tube was charged with 1,500 g of 2-acrylamido-2-methylpropanesulfonic acid, 2,060 g of trimethyl orthoformate, and 1.5 g of p-benzoquinone. The resultant mixture was reacted for 5 hours at 80° C. The reaction mixture was cooled, and concentrated under reduced pressure. The deposited crystals were filtered, then added into 5 L of water to disperse and wash, then filtered, and washed twice with 2.5 L of water. The obtained crystals were wind-dried at 30° C., then dispersed and washed with 4 L of hexane, and filtered. The obtained crystals were dried under reduced pressure at 30° C. to obtain 1,063 g of the monomer 4D represented by Formula (4D).

(4D)

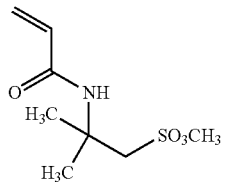

<Monomer 4E>

The 2-acrylamido-2-methylpropanesulfonic acid represented by Formula (4E) was used as monomer 4E.

(4E)

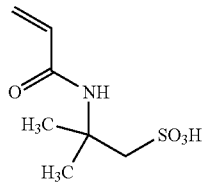

<Monomer 4F>

The 2-methacrylamido-5-methoxybenzenesulfonic acid represented by Formula (4F) was used as monomer 4F.

(4F)

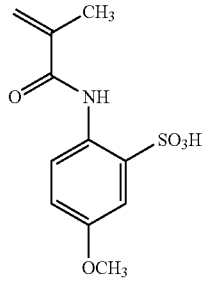

<Monomer 4G>

The 2-acrylamidobenzene sulfonic acid represented by Formula (4G) was used as monomer 4G.

(4G)

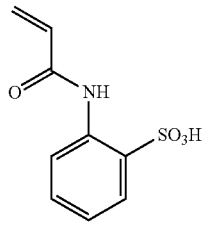

The esterification of the sulfonic acid group may also be performed after producing the resin containing the sulfonic acid group. A known method may be employed for the esterification of the sulfonic acid in the resin. Specific examples thereof include a method in which sulfonic acid is chlorinated and then reacted with an alcohol, a method in which a methyl esterifying agent such as dimethylsulfuric acid, trimethylsilyldiazomethane, and trimethyl phosphate is used, and a method in which an orthoformate is used. Among these, the best esterification method in the present invention is the method in which an orthoformate is used. This method enables easy esterification of the sulfonic acid by allowing an orthoformate having a desired alkyl group to react with the sulfonic acid-containing resin under relatively mild conditions. Further, this method also enables easy control of the percentage of esterification based on the reaction temperature, reaction time, the amount of the orthoformate, and the amount of solvent. Specific examples of the orthoformate include trimethyl orthoformate, triethyl orthoformate, tri-n-propyl orthoformate, tri-iso-propyl orthoformate, tri-n-butyl orthoformate, tri-sec-butyl orthoformate, tri-tert-butyl orthoformate, and mixtures of these.

A known vinyl monomer may be used as the vinyl monomer having the structure of the unit B. Examples thereof include 3-vinylsalicylic acid, 4-vinylsalicylic acid, 5-vinylsalicylic acid, 6-vinylsalicylic acid, 3-vinyl-5-isopropylsalicylic acid, 3-vinyl-5-t-butylsalicylic acid, 4-vinyl-6-t-butylsalicylic acid, 3-isopropenyl-5-t-butylsalicylic acid, and 3-t-butyl-5-vinylsalicylic acid.

The effects of the present invention affect the substituent position of the vinyl group of the vinyl monomer forming unit B. From the perspective of stabilizing the charge characteristic, 4-vinylsalicylic acid is preferred as the vinyl monomer, and 5-vinylsalicylic acid is more preferred. Further, in the 5-vinylsalicylic acid, still more preferred is 3-t-butyl-5-vinylsalicylic acid having a substituent at the 3 position. Although the reason why there is a difference in the effects based on the position of the substituent is not clear, it is thought that it may be due to the electron state of the salicylic acid moiety in the unit B changing based on the substituent position, thereby producing a difference in the ability to dissipate charge into the binder resin which is thought to be an effect of the unit B.

Production examples of a vinyl monomer having the structure of the unit B are shown below.

<Monomer 5A>

The monomer (5A) represented by Formula (5A) can be produced using the methods described in Japanese Patent Application Laid-Open No. S63-270060 and the Journal of Polymer Science Polymer Chemistry Edition 18, 2755 (1980).

(5A)

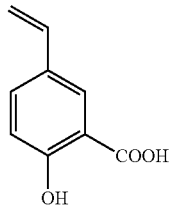

<Monomer 5B>

The monomer (5B) represented by Formula (5B) can be produced using the method described in Japanese Patent Application Laid-Open No. S62-187429.

(5B)

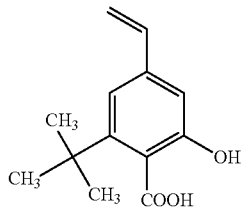

<Monomer 5C>

The monomer (5C) represented by Formula (5C) can be produced using the methods described in the above-described Japanese Patent Application Laid-Open No. 563-270060 and the Journal of Polymer Science: Polymer Chemistry Edition 18, 2755 (1980).

(5C)

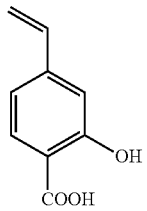

<Monomer 5D>

The monomer (5D) represented by Formula (5D) can be produced using the method described in Bioorganic & Medicinal Chemistry, 15 (15), 5207 (2007).

(5D)

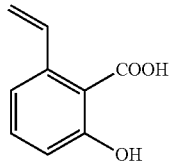

On the other hand, for a condensation polymerized resin, the substituents of the unit A and unit B are usually synthesized utilizing a reactive group included in the resin after the resin is produced. For example, if a carboxyl group is present in the resin, a unit can be addition react by a dehydration-condensation reaction using an amine compound having the unit A or B. The compound having the unit A or B can also be produced using a method which reacts an amino group or a hydroxy group in the resin utilizing an epoxy group adduct or an acid halide. During this reaction, the added amount of unit A or B can be adjusted based on the introduced amount of the respective reactive group in the resin or based on the charged amount of the compound having the unit.

A known method may be used as the method for introducing the reactive group when producing the resin. For example, for a polyester, a carboxyl group or a hydroxy group present on the end of the resin may be used as is. When further increasing a reactive group, a method may be employed in which an uncondensed carboxylic acid is allowed to remain using a trifunctional carboxylic acid as the polyester monomer.

A known unit may be used as the other unit forming the resins PA and PB. Specific examples include a vinyl polymer, a resin having a polyester structure, and a hybrid resin formed from a combination of these. Examples of the monomer for the vinyl polymers include styrenes such as styrene and α-methylstyrene, and its derivatives; vinyl esters such as vinyl acetate; (meth)acrylic acid esters such as (meth)acrylic acid methyl, (meth)acrylic acid butyl, (meth)acrylic acid-2-ethylhexyl, and (meth)acrylic acid-2-hydroxyethyl; vinyl ethers such as vinyl methyl ether; and unsaturated dibasic acids such as maleic acid, or anhydrides thereof.

Examples of a polyhydric alcohol component forming the resin having a polyester structure are as follows. Examples of a divalent alcohol component include bisphenol A alkylene oxide adducts such as polyoxypropylene(2.2)-2,2-bis(4-hydroxyphenyl)propane and polyoxyethylene(2.0)-2,2-bis(4-hydroxyphenyl)propane; and diols such as ethylene glycol, 1,4-butanediol, and neopentyl glycol.

Examples of a trivalent or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a polyvalent carboxylic acid component include aromatic dicarboxylic acids such as phthalic acid, isophthalic acid, and terephthalic acid, or an anhydride thereof; alkyl dicarboxylic acids such as succinic acid, adipic acid, sebacic acid, and azelaic acid, or an anhydride thereof; succinic acid substituted with an alkyl group having 6 or more and 12 or less carbon atoms, or an anhydride thereof; and unsaturated dicarboxylic acids such as fumaric acid, maleic acid, and citraconic acid, or an anhydride thereof.

A known method may be used as the method for hybridizing the polyester resin by a vinyl monomer. Specific examples include a method in which a peroxide initiator is used to perform vinyl modification of polyester, a method in which a polyester resin having an unsaturated group is subjected to graft modification to produce a hybrid resin, and a method in which a radical-polymerizable compound is added using a carboxyl group or a hydroxyl group present on the end of the polyester. A known vinyl monomer may be used as the vinyl monomer that can be used for hybridizing the polyester resin. Examples thereof include the above-described vinyl monomers.

The added amounts of the resin PA and the resin PB are, based on 100 parts by mass of the binder resin, respectively, preferably 0.1 parts by mass or more and 50 parts by mass or less, and more preferably 0.5 parts by mass or more and 30 parts by mass or less.

A known binder resin may be used as the binder resin used in the toner according to the present invention. Examples include a vinyl resins such as a styrene-acrylic resin, a polyester resin, or a hybrid resin formed by binding these together. Further, the vinyl monomer unit in the vinyl resins or the hybrid resin may have a crosslinked structure which is crosslinked by a crosslinking agent having two or more vinyl groups. Examples of the crosslinking agent include aromatic divinyl compounds such as divinylbenzene and divinylnaphthalene.

The toner according to the present invention may be used as a magnetic toner. In this case, examples of magnetic materials that can be used include iron oxides such as magnetite, maghematite and ferrite, or iron oxides including another metal oxide; and metals such as Fe, Co and Ni, or alloys of the metal with a metal such as Al, Co, Cu, Pb, Mg, Ni, Sn, Zn, Sb, Ca, Mn, Se, and Ti, and mixtures of these. More specifically, examples include ferrosoferric oxide ($Fe_3O_4$), iron sesquioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$). The above-described magnetic materials may be used as one kind or as a combination of two kinds or more. Especially preferred magnetic materials are a fine powder of ferrosoferric oxide or γ-iron sesquioxide.

These magnetic materials preferably have an average particle size of 0.1 μm or more and 2 μm or less, and more preferably 0.1 μm or more and 0.3 μm or less. The magnetic characteristics under application of 795.8 kA/m (10 K oersteds) are, a coercive force (Hc) of 1.6 kA/m or more and 12 kA/m or less (20 oersteds or more and 150 oersteds or less), and a saturation magnetization (σs) of 5 $Am^2$/kg or more and 200 $Am^2$/kg or less, preferably 50 $Am^2$/kg or more and 100 $Am^2$/kg or less. The residual magnetization (σr) is preferably 2 $Am^2$/kg or more and 20 $Am^2$/kg or less.

The used amount of the magnetic material may be 10 parts by mass or more and 200 parts by mass or less, and preferably 20 parts by mass or more and 150 parts by mass or less, based on 100 parts by mass of the binder resin.

On the other hand, a known colorant, such as various conventionally-known dyes and pigments, may be used as the colorant for when the toner is used as a non-magnetic toner.

Examples of a magenta color pigment include C.I. Pigment Red 3, 5, 17, 22, 23, 38, 41, 112, 122, 123, 146, 149, 178, 179, 190, 202, and C.I. Pigment Violet 19 and 23. This pigment may be used by itself, or together with a dye.

Examples of a cyan color pigment include C.I. Pigment Blue 15, 15:1, 15:3, or a copper phthalocyanine pigment substituted with 1 to 5 phthalimidomethyl groups on the phthalocyanine skeleton.

Examples of a yellow color pigment include C.I. Pigment Yellow 1, 3, 12, 13, 14, 17, 55, 74, 83, 93, 94, 95, 97, 98, 109, 110, 154, 155, 166, 180, and 185.

Examples of a black colorant include carbon black, aniline black, acetylene black, titanium black, and a pigment whose color has been adjusted to black using the yellow/magenta/cyan colorants shown above.

The toner according to the present invention may also include a release agent. Examples of a release agent include aliphatic hydrocarbon waxes such as a low-molecular-weight polyethylene, a low-molecular-weight polypropylene, a microcrystalline wax, and a paraffin wax; oxides of aliphatic hydrocarbon waxes such as polyethylene oxide wax; block copolymers of aliphatic hydrocarbon waxes; waxes mainly formed from fatty acid esters such as carnauba wax, sasol wax, montanic acid ester wax; partially or wholly deacidified fatty acid esters such as a deacidified carnauba wax; partially esterified compounds of fatty acids and polyhydric alcohols such as behenic monoglyceride; and methyl ester compounds having a hydroxyl group obtained by the hydrogenation of a vegetable oil.

The release agent preferably has a molecular weight distribution having a main peak in the molecular weight range of 400 or more and 2,400 or less, and more preferably in the range of 430 or more and 2,000 or less. The main peak in the range allows the toner to be a preferable heat characteristic. The total added amount of the release agent is preferably 2.5 parts by mass or more and 40.0 parts by mass or less, and more preferably 3.0 parts by mass or more and 15.0 parts by mass or less, based on 100 parts by mass of the binder resin.

Means for producing the toner particles can include kneading and pulverizing method, suspension polymerization method, dissolution suspension method, and emulsification aggregation method. Further, to be more effective both charging characteristic control and pigment dispersion, it is preferred to employ the suspension polymerization method, the dissolution suspension method, or emulsification aggregation method, in which the toner particles are produced in an aqueous medium.

In the kneading and pulverizing method, the binder resin, the colorant, the resin PA, the resin PB, and optionally other additives are thoroughly mixed using a mixer such as a Henschel mixer or a ball mill. The toner particles can be obtained by performing melt kneading using a heating kneader such as a kneader or an extruder, cooling the kneaded product to form a solidified product, then pulverizing the solidified product, and classifying the pulverized product.

In the suspension polymerization method, the toner particles can be produced by dissolving or finely dispersing the resin PA and the resin PB along with the other necessary components in a polymerizable monomer, suspension granulating in an aqueous medium, and then polymerizing the monomer included in the droplet.

Conventionally, when producing a toner by suspension polymerization, if the amount of resin corresponding to the resin PA was increased by itself to improve the charge amount and the charging rate, there was an adverse impact on the pigment dispersion properties. Although the mechanism is not clear, this is thought to be due to the stability of the interface between the pigment and the binder resin being destroyed as a result of the resin PA excessively adsorbing to the pigment, thereby inducing aggregation of the pigment particles. Based on their investigations, the present inventors discovered that the pigment dispersion properties in a polymerizable monomer improve if the resin PB having unit B, which is a salicylic acid structure, is also included together with the resin PA. Consequently, both charge rise and pigment dispersion properties can be achieved. Although the mechanism is not clear, this is thought to be due to a weakening in the interaction between the pigment and the resin PA as a result of the salicylic acid structure included in the unit B suppressing the adsorption of the resin PA to the pigment, so that pigment aggregation is suppressed.

In the dissolution suspension method, the toner particles can be produced by dissolving or dispersing the resin PA and the resin PB in an organic solvent along with the other necessary components, suspension granulating in an aqueous medium, and then removing the organic solvent included in the droplet.

In the emulsification aggregation method, the toner particles can be produced by finely dispersing the resin PA and the resin PB in an aqueous medium by a method such as phase inversion emulsification, mixing with fine particles of the other necessary components, and aggregating the resultant mixture into toner particles in the aqueous medium by controlling the zeta potential of the particles.

A toner having a flowability improver on the toner particle surface can be obtained by thoroughly mixing the toner particles with the flowability improver by a mixer such as a Henschel mixer. Examples of the flowability improver include fluorine resin powders such as a fluorinated vinylidene fine powder and a polytetrafluoroethylene fine powder; silica fine powders such as a silica fine powder produced by a wet-process and a silica fine powder produced by a dry-process, and silica fine powders treated by subjecting the surface of such silica fine powders to a surface treatment with a treatment agent such as a silane coupling agent, a titanium coupling agent, or silicone oil; titanium oxide fine powders; alumina fine powders; surface-treated titanium oxide fine powders; and surface-treated alumina fine powders. The flowability improver confers a good effect if it has a specific surface area as measured by the BET method based on nitrogen adsorption of 30 $m^2/g$ or more, and preferably $m^2/g$ or more. The used amount of the flowability improver may be 0.01 parts by mass or more and 8.0 parts by mass or less, and preferably 0.1 parts by mass or more and 4.0 parts by mass or less, based on 100 parts by mass of toner particles.

The weight average particle size (D4) of the toner may be 3.0 μm or more and 15.0 μm or less, and preferably 4.0 μm or more and 12.0 μm or less.

The toner according to the present invention may be used as a two-component developer by mixing with a magnetic carrier. Examples of magnetic carriers that may be used include metal particles such as surface-oxidized or unoxidized iron, lithium, calcium, magnesium, nickel, copper, zinc, cobalt, manganese, chromium, and rare earths; alloy particles and oxide particles thereof; and microparticulated ferrites.

In a developing method in which an alternate current bias is applied to a developing sleeve, it is preferred to use a coated carrier obtained by coating the surface of a magnetic carrier core with a resin. Examples of the coating method that may be used include a method in which a coating liquid prepared by dissolving or suspending a coating material such as a resin in a solvent is coated on the surface of the magnetic carrier cores, and a method in which the magnetic carrier cores and the coating material of powder form are mixed.

Examples of the coating material of the magnetic carrier core include silicone resin, polyester resin, styrene resins, acrylic resins, polyamide, polyvinyl butyral, and aminoacrylate resin. One or plural of these are used. The treatment amount of the above coating material is 0.1% by mass or more and 30% by mass or less (preferably 0.5% by mass or more and 20% by mass or less) based on the carrier core particles. The average particle size of the magnetic carrier is preferably 10 μm or more and 100 μm or less, and more preferably 20 μm or more and 70 μm or less, based on a volume reference 50% particle size (D50). If preparing a two-component developer, good results can be obtained by setting the mixing ratio to 2% by mass or more and 15% by mass or less, and preferably 4% by mass or more and 13% by mass or less, as a toner concentration in the developer.

The toner according to the present invention may also include an organic metal compound. Examples of the organic metal compound include a metal compound of the aromatic oxycarboxylic acid derivatives represented below.

(a)

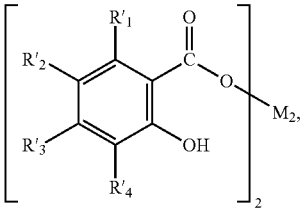

(b)

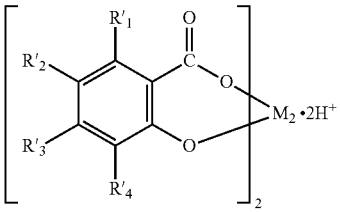

-continued (c)

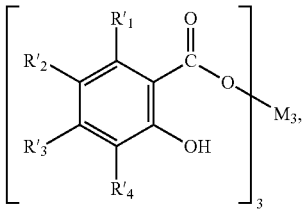

(d)

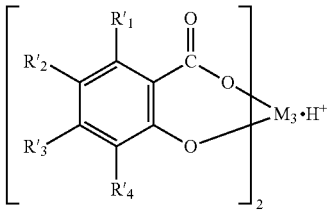

(e)

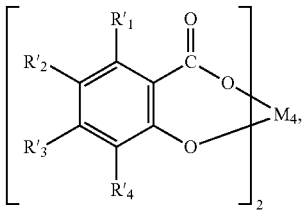

(f)

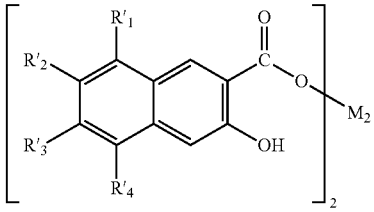

(g)

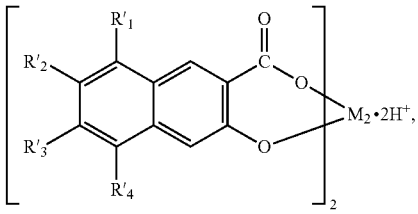

(h)

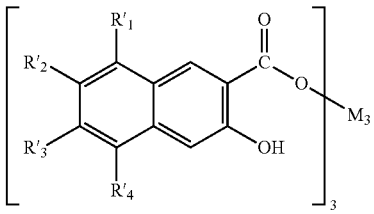

(i)

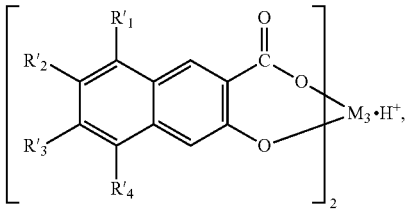

-continued (j)

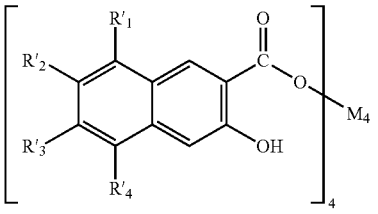

$M_2$ in the above formulae represents a divalent metal atom. Examples thereof include $Mg^{2+}$, $Ca^{2+}$, $Sr^{2+}$, $Pb^{2+}$, $Fe^{2+}$, $Co^{2+}$, $Ni^{2+}$, $Zn^{2+}$, and $Cu^{2+}$. $M_3$ in the above formulae represents a trivalent metal atom. Examples thereof include $Al^{3+}$, $Cr^{3+}$, $Fe^{3+}$, and $Ni^{3+}$. $M_4$ in the above formulae represents a tetravalent metal atom. Examples thereof include $Zr^{4+}$, $Hf^{4+}$, $Mn^{4+}$, and $Co^{4+}$. Among these metal atoms, $Al^{3+}$, $Fe^{3+}$, $Cr^{3+}$, $Zr^{4+}$, $Hf^{4+}$ and $Zn^{2+}$ are preferred.

$R_1'$ to $R_4'$ in the formulae represent the same or a different group. Examples thereof include a hydrogen atom, an alkyl group having 1 or more and 12 or less carbon atoms, an alkenyl group having 2 or more and 12 or less carbon atoms, —OH, —$NH_2$, —$NH(CH_3)$, —$N(CH_3)_2$, —$OCH_3$, —$O(C_2H_5)$, —COOH, or —$CONH_2$. Preferred examples of $R_1'$ include a hydroxyl group, an amino group, and a methoxy group. Among these, a hydroxyl group is preferred.

The binder resin used in the toner according to the present invention is not especially limited. Examples thereof include styrene resins, acrylic resins, methacrylic resins, styrene-acrylic resins, styrene-methacrylic resins, polyethylene resin, polyethylene-vinyl acetate resins, vinyl acetate resin, polybutadiene resin, phenolic resin, polyurethane resin, polybutyral resin, polyester resin, and hybrid resin bonded to any of these resins. Among these, from the perspective of toner characteristics, it is preferred to use styrene resins, acrylic resins, methacrylic resins, styrene-acrylic resins, styrene-methacrylic resins, polyester resin, or hybrid resin in which styrene-acrylic resins or styrene-methacrylic resins is bonded with polyester resin.

As the above-described polyester resin, a polyester resin normally produced using a polyhydric alcohol, and a carboxylic acid, carboxylic acid anhydride, or carboxylate ester as the raw material monomers can be used. Specifically, a polyhydric alcohol component and a polyvalent carboxylic acid component similar to the above-described polyester resin can be used. Among such examples, especially preferred is a polyester resin formed by polycondensation of the following components: as a diol component, a bisphenol derivative; and as an acid component, a divalent or higher carboxylic acid or acid anhydride thereof; and a carboxylic acid component consisting of a lower alkyl ester such as fumaric acid, maleic acid, maleic anhydride, phthalic acid, terephthalic acid, trimellitic acid, pyromellitic acid.

The measurement methods used in the present invention will now be described below.

<Molecular Weight of Resin>

The molecular weight and the molecular weight distribution of the resin PA and the resin PB are calculated in terms of polystyrene by gel permeation chromatography (GPC). Since the column elution rate depends on the amount of sulfonic acid groups, the exact molecular weight and molecular weight distribution of the resin PA, which has a sulfonic acid group, cannot be measured. Consequently, a sample whose sulfonic acid groups have been capped has to be prepared in advance. It is preferred to use methyl esterification for the capping, and a commercially-available methyl esterification agent can be used. Specifically, a method which treats using trimethylsilyldiazomethane may be employed.

Measurement of molecular weight by GPC is carried out as follows. The above-described resin is added into THF (tetrahydrofuran), and the resultant solution is left for 24 hours at room temperature. Then, the solution is filtered using a solvent-resistant membrane filter "Maeshoridisk" (manufactured by Tosoh Corporation) having a pore size of 0.2 μm to prepare a sample solution and measurement is conducted in the following conditions. This sample is prepared by adjusting the amount of THF so that the resin concentration is about 0.8% by mass. If the resin does not readily dissolve in THF, a basic solvent such as DMF may also be used.

Apparatus: HLC 8120 GPC (detector: RI) (Tosoh Corporation)

Column: Series of seven columns, Shodex KF-801, 802, 803, 804, 805, 806, and 807 (manufactured by Showa Denko K.K.)

Eluent: Tetrahydrofuran (THF)

Flow Rate: 1.0 ml/min

Oven Temperature: 40.0° C.

Sample Injection Amount: 0.10 ml

To calculate the molecular weight of the sample, a molecular weight calibration curve prepared using the standard polystyrene resin columns shown below is used. Specifically, columns having the trade name "TSK Standard Polystyrene F-850, F-450, F-288, F-128, F-80, F-40, F-20, F-10, F-4, F-2, F-1, A-5000, A-2500, A-1000, and A-500" manufactured by Tosoh Corporation are used.

<Composition Analysis>

The structure of unit A and unit B can be determined using the following measurement apparatus.

[FT-IR Spectra]

AVATAR 360 FT-IR manufactured by Nicolet

[$^1$H-NMR and $^{13}$C-NMR]

FT-NMR JNM-EX400 manufactured by JEOL Ltd. (used solvent: heavy chloroform)

<Method for Measuring S Amount in Resin PA>

The number of moles of unit A in the resin PA corresponds to the number of moles of sulfur element in the resin. Therefore, quantification of unit A is carried out by measuring the amount of sulfur element in the resin in the following manner.

<Quantification of Sulfur Element in the Resin>

The method for quantifying the amount of sulfur element containing in the resin is as follows. Specifically, the resin is introduced into an automatic sample combustion apparatus (apparatus name: Ion Chromatograph Pre-Treatment Apparatus AQF-100 model, manufactured by Dia Instruments Co., Ltd.), and the resin is combusted to form a gas, which is absorbed in an absorption solution.

Next, the amount of sulfur element in the resin or the toner particles is measured by ion chromatography (apparatus name: Ion Chromatograph ICS2000, column: IONPAC AS17, manufactured by Nippor Dionex K.K.). The obtained value is divided by the atomic weight of sulfur (32.06) to calculate the number of moles of sulfur atoms (μmol/g).

<Method for Measuring Hydroxyl Value in Resin PB>

The hydroxyl value is the number of milligrams of potassium hydroxide required to neutralize the acetic acid bonded to a hydroxyl group when 1 g of sample is acetylated. The hydroxyl value of the binder resin is measured based on JIS K 0070-1992, and specifically, is measured according to following procedures.

(1) Reagent Preparation

A 100 ml measuring flask is charged with 25 g of special grade acetic anhydride, then charged with pyridine to bring the total amount 100 ml. The mixture is thoroughly shaken and mixed to obtain an acetylated reagent. The obtained acetylated reagent is stored in a brown bottle to prevent it from coming into contact with humidity, carbon dioxide gas and the like.

1.0 g of phenolphthalein is dissolved in 90 ml of ethyl alcohol (95 vol %). The mixture is then charged with ion-exchange water to bring the solution to 100 ml, whereby a phenolphthalein solution is obtained.

35 g of special grade potassium hydroxide is dissolved in 20 ml of water, and the resultant mixture is charged with ethyl alcohol (95 vol %) to bring the solution 1 L. The mixture is put in an alkali-resistant container to prevent it from coming into contact with carbon dioxide gas and the like, and left for 3 days. The mixture is then filtered to obtain a potassium hydroxide solution. The obtained potassium hydroxide solution is stored in an alkali-resistant container. The factor of the potassium hydroxide solution is determined by charging 25 ml of 0.5 mol/l hydrochloric acid into a conical flask, adding several drops of the phenolphthalein solution thereto, and titrating with the above potassium hydroxide solution, from the amount of the potassium hydroxide solution required for neutralization. The used 0.5 mol/l hydrochloric acid is produced based on JIS K 8001-1998.

(2) Operation (A) Real Test 1.0 g of a sample of pulverized binder resin is weighed into a 200 ml round-bottom flask, and then 5.0 ml of the above-described acetylated reagent is precisely charged into the flask using a whole pipette. At this stage, if the sample does not readily dissolve in the acetylated reagent, a small amount of special grade toluene may be added and dissolved.

A small funnel is placed in the mouth of the flask, and about 1 cm of the bottom portion of the flask is dipped and heated in a glycerin bath having a temperature of about 97° C. To prevent the neck of the flask from being heated by the heat of the bath at this point, it is preferred to place a piece of thick paper with a round hole in it around the base of the flask neck.

After 1 hour, the flask is removed from the glycerin bath and left to cool. After cooling, 1 ml of water is added from the funnel, and the mixture is shaken to hydrolyze the acetic anhydride. Further, to completely hydrolyze the acetic anhydride, the flask is again heated in the glycerin bath for 10 minutes. After cooling, the funnel and the walls of the flask are washed with 5 ml of ethyl alcohol.

Several drops of the above-described phenolphthalein solution are added as an indicator, and the solution is titrated with the above-described potassium hydroxide solution. The titration end point is when the pale pink color of the indicator continues for about 30 seconds.

(B) Blank Test

Titration is carried out in the same manner as in the above operation, except that a sample of the binder resin is not used.

(3) The hydroxyl value is calculated by substituting the obtained results into the following equation.

$$A=[\{(B-C)\times 28.05\times f\}/S]+D$$

Here, A represents the hydroxyl value (mgKOH/g), B represents the added amount (ml) of the potassium hydroxide solution in the blank test, C represents the added amount (ml) of the potassium hydroxide solution in the real test, f represents the factor of the potassium hydroxide solution, S represents the sample (g), and D represents the acid value (mgKOH/g) of the binder resin.

<Method for Measuring Weight Average Particle Size (D4) and Number Average Particle Size (D1)>

The weight average particle size (D4) and the number average particle size (D1) of the toner are calculated as follows. As the measurement apparatus, a precision particle size distribution measurement apparatus is used based on a pore electrical resistance method provided with a 100 μm aperture tube, the "Coulter Counter Multisizer 3", (registered trademark, manufactured by Beckman Coulter Inc.). The setting of the measurement conditions and analysis of the measurement data is carried out using the dedicated software included with the apparatus, "Beckman Coulter Multisizer 3 Version 3.51" (manufactured by Beckman Coulter Inc.). Measurement is performed with 25,000 effective measurement channels.

As the electrolyte solution to be used in the measurement, a solution prepared by dissolving special grade sodium chloride in ion-exchange water to have a concentration of about 1% by mass, for example, an "Isoton II" (manufactured by Beckman Coulter, Inc.) can be used.

The dedicated software was set in the following manner prior to carrying out measurement and analysis. In the "change standard operation method (SOM)" screen of the dedicated software, the total count number of control modes is set to 50,000 particles, the number of times of measurement is set to 1, and a value obtained by using "standard particles 10.0 μm" (manufactured by Beckman Coulter, Inc.) is set as a Kd value. A threshold and a noise level are automatically set by pressing a threshold/noise level measurement button. In addition, the current is set to 1,600 μA, gain is set to 2, the electrolyte solution is set to Isoton II, and a check mark is placed in "flush of aperture tube after measurement" check box. In the "setting for conversion from pulse to particle size" screen of the dedicated software, a bin interval is set to logarithmic particle size, the number of particle size bins is set to 256, and the particle size range is set to the range of 2 μm or more and 60 μm or less.

The specific measurement method is as follows.

(1) About 200 ml of the electrolyte solution is added into a 250 ml round-bottom glass beaker designed for the Multisizer 3. The beaker is set in a sample stand, and the electrolyte solution in the beaker is stirred with a stirrer rod at 24 rotations/sec in a counterclockwise direction. Then, dirt and air bubbles in the aperture tube are removed by the "aperture flush" function of the dedicated software.

(2) About 30 ml of the electrolyte solution is added into a 100 ml flat-bottom glass beaker. Then, the beaker is charged with, as a dispersant, about 0.3 ml of a diluted solution prepared by diluting "Contaminon N" (a 10% by mass aqueous solution of a neutral detergent for washing a precision measuring device, containing a nonionic surfactant, a anionic surfactant, and an organic builder, and having a pH of 7, which is manufactured by Wako Pure Chemical Industries, Ltd.) with ion-exchange water by a factor of about 3 in terms of mass.

(3) About 3.3 l of ion-exchange water is charged into the water tank of an ultrasonic disperser "Ultrasonic Dispension System Tetora 150" (manufactured by Nikkaki Bios, Co. Ltd.) in which two oscillators having an oscillating frequency of 50 kHz are installed so as to be out of phase by 180°, and which has an electrical output of 120 W. About 2 ml of the Contaminon N is added into the water tank.

(4) The beaker in the above section (2) is set in the beaker fixing hole of the ultrasonic disperser, and the ultrasonic disperser is operated. Then, the height position of the beaker is adjusted so that the liquid level of the electrolyte solution in the beaker can resonate to the fullest extent possible.

(5) About 10 mg of the toner is added portionwise into and dispersed in the electrolyte solution in the beaker from the above section (4) while irradiating the electrolyte solution with ultrasonic waves. Then, the ultrasonic dispersion treatment is continued for an additional 60 seconds. During the ultrasonic dispersion, the temperature of the water in the water tank is appropriately adjusted so as to be in the range of 10° C. or more and 40° C. or less.

(6) The electrolyte solution from the above section (5), in which the toner has been dispersed, is added dropwise with a pipette into the round-bottom beaker from the above section (1) placed in the sample stand. Then, the measurement concentration is adjusted to about 5%. Measurement is performed until the 50,000 particles are measured.

(7) The measurement data is analyzed with the dedicated software included with the apparatus, and the weight average particle size (D4) and the number average particle size (D1) are calculated. The "average size" on the "analysis/volume statistics (arithmetic average)" screen when the dedicated software is set to graph/vol % is the weight average particle size (D4), and the "average size" on the "analysis/number statistics (arithmetic average)" screen when the dedicated software is set to graph/number % is the number average particle size (D1).

EXAMPLES

The present invention will now be described in more detail based on the following examples. In the examples, all "parts" are expressed in terms of mass.

PA resins 1 to 7 and PB resins 1 to 4 were synthesized by the following method.

Synthesis Example 1 of a PA Resin (PA-1)

A reaction vessel equipped with a stirrer, a condenser, a thermometer, and a nitrogen inlet tube was charged with 200 parts of xylene, which was then refluxed under a nitrogen flow.

Next, 15.0 parts of 2-acrylamido-5-methoxybenzene sulfonic acid methyl, 69.0 parts of styrene, 16.0 parts of 2-ethylhexyl acrylate, and 5.0 parts of dimethyl-2,2'-azobis(2-methylpropionate) were mixed. The resultant mixture was added dropwise into the reaction vessel while stirring, and then held for 10 hours. Subsequently, the solvent was removed by distillation, and the resultant product was dried at 40° C. under reduced pressure to obtain resin PA-1. The obtained resin PA-1 was confirmed to contain 490 μmol/g of a unit derived from sulfonic acid based on the results of quantification of the amount of sulfur atoms by elemental analysis. The composition of the resins produced below and their unit content and molecular weight are shown in Tables 1-1 and 1-2.

Synthesis Example 2 of a PA Resin (PA-2)

Resin PA-2 was obtained by performing resin PA synthesis in the same manner as in the Synthesis Example 1, except that the following materials were used.

6.0 parts of 2-acrylamido-2-methylpropanesulfonic acid
78.0 parts of styrene
16.0 parts of 2-ethylhexyl acrylate
5.0 parts of dimethyl-2,2'-azobis(2-methylpropionate)

The obtained resin PA-2 was confirmed to contain 263 μmol/g of a unit derived from sulfonic acid based on the results of quantification of the amount of sulfur atoms by elemental analysis.

Synthesis Example 3 of a PA Resin (PA-3)

Resin PA-3 was obtained by performing resin PA synthesis in the same manner as in the Synthesis Example 1, except that the following materials were used.

12.0 parts of 2-acrylamido-2-methylpropane sulfonic acid methyl
72.0 parts of styrene
16.0 parts of 2-ethylhexyl acrylate
5.0 parts of dimethyl-2,2'-azobis(2-methylpropionate)

The obtained resin PA-3 was confirmed to contain 522 μmol/g of a unit derived from sulfonic acid based on the results of quantification of the amount of sulfur atoms by elemental analysis.

Synthesis Example 4 of a PA Resin (PA-4)

Resin PA-4 was obtained by performing resin PA synthesis in the same manner as in the Synthesis Example 1, except that the following materials were used.

8.0 parts of 2-acrylamido-5-methoxybenzene sulfonic acid
76.0 parts of styrene
16.0 parts of 2-ethylhexyl acrylate
5.0 parts of dimethyl-2,2'-azobis(2-methylpropionate)

The obtained resin PA-4 was confirmed to contain 290 μmol/g of a unit derived from sulfonic acid based on the results of quantification of the amount of sulfur atoms by elemental analysis.

Synthesis Example 5 of a PA Resin (PA-5)

Resin PA-5 was obtained by performing resin PA synthesis in the same manner as in the Synthesis Example 1, except that the following materials were used.

16.0 parts of 2-acrylamido-5-methoxybenzene sulfonic acid methyl
74.0 parts of styrene
10.0 parts of n-butyl acrylate
5.0 parts of dimethyl-2,2'-azobis(2-methylpropionate)

The obtained resin PA-5 was confirmed to contain 539 μmol/g of a unit derived from sulfonic acid based on the results of quantification of the amount of sulfur atoms by elemental analysis.

Synthesis Example 6 of a PA Resin (PA-6)

Production of Polyester P-1: 69.0 Parts of a 2.2 mole adduct of bisphenol A-propylene oxide, 28.0 parts of terephthalic acid, 3.0 parts of fumaric acid, and 0.005 parts of dibutyltin oxide were added into a four-necked flask. A thermometer, stirring rod, condenser, and nitrogen inlet tube were attached to the flask, and then the mixture was reacted at 220° C. for 5 hours under a nitrogen atmosphere to obtain polyester resin P-1.

A reaction vessel equipped with a stirrer, a condenser, a thermometer, and a nitrogen inlet tube was charged with 200 parts of xylene, which was then refluxed under a nitrogen flow. 70 parts of the above-produced resin P-1 was added into the mixture, and dissolved.

Next, 15.0 parts of 2-acrylamide-5-methoxybenzene sulfonic acid methyl, 15.0 parts of styrene, and 1.5 parts of dimethyl-2,2'-azobis(2-methylpropionate) were mixed. The resultant mixture was added into the reaction vessel while stirring, and then held for 10 hours. Subsequently, the solvent was removed by distillation, and the resultant product was dried at 40° C. under reduced pressure to obtain resin PA-6.

The obtained resin PA-6 was confirmed to contain 502 μmol/g of a unit derived from sulfonic acid based on the results of quantification of the amount of sulfur atoms by elemental analysis.

Synthesis Example 7 of a PA Resin (PA-7)

Production of Polyester P-2: 67.8 Parts of a 2.2 mole adduct of bisphenol A-propylene oxide, 22.2 parts of terephthalic acid, 10.0 parts of trimellitic anhydride, and 0.005 parts of dibutyltin oxide were added into a four-necked flask. A thermometer, stirring rod, condenser, and nitrogen inlet tube were attached to the flask, and then the mixture was reacted at 220° C. for 5 hours under a nitrogen atmosphere to obtain polyester resin P-2. The hydroxyl value of this resin P-2 was measured to be 4.8 mgKOH/g.

Next, a reaction tank equipped with a condenser, a stirrer, a thermometer, and a nitrogen inlet tube was charged with 80 parts of the polyester resin P-2 and 20 parts of 4-aminobenzene sulfonic acid, then charged with 270 parts of pyridine. The resultant mixture was stirred, then charged with 96 parts of triphenyl phosphite, and heated at 120° C. for 6 hours. After the reaction finished, the mixture was reprecipitated in 360 parts of ethanol, and recovered. The obtained polymer was washed twice using 140 parts of 1 N hydrochloric acid then washed twice using 140 parts of water, and dried under reduced pressure. Based on IR measurement, it was confirmed that the peak at 1,695 $cm^{-1}$ derived from carboxylic acid had decreased, and that there was a new peak at 1,658 $cm^{-1}$ derived from an amide bond. In addition, based on the $^{1}H$-NMR results, the peak derived from the aromatic ring of the 4-aminobenzene sulfonic acid had shifted. The obtained resin PA-7 was confirmed to contain 476 μmol/g of a unit derived from sulfonic acid based on the results of quantification of the amount of sulfur atoms by elemental analysis.

Synthesis Example 1 of a PB Resin (PB-1)

A reaction vessel equipped with a stirrer, a condenser, a thermometer, and a nitrogen inlet tube was charged with 200 parts of xylene, which was then refluxed under a nitrogen flow.

Next, 9.0 parts of 5-vinylsalicylic acid, 75.0 parts of styrene, 16.0 parts of 2-ethylhexyl acrylate, and 5.0 parts of dimethyl-2,2'-azobis(2-methylpropionate) were mixed. The resultant mixture was added into the reaction vessel while stirring, and then held for 10 hours. Subsequently, the solvent was removed by distillation, and the resultant product was dried at 40° C. under reduced pressure to obtain resin PB-1. The obtained resin PB-1 was confirmed to have a hydroxyl value of 30.3 mgKOH/g, specifically, contain 540 μmol/g of a unit derived from salicylic acid, based on the results of measuring the hydroxyl value.

Synthesis Example 2 of a PB Resin (PB-2)

Resin PB-2 was obtained by performing resin PB synthesis in the same manner as in the Synthesis Example 1, except that the following materials were used.

12.0 parts of 3-tertiary butyl-5-vinylsalicylic acid
72.0 parts of styrene
16.0 parts of 2-ethylhexyl acrylate
5.0 parts of dimethyl-2,2'-azobis(2-methylpropionate)

The obtained resin PB-2 was confirmed to have a hydroxyl value of 28.7 mgKOH/g, specifically, contain 511 μmol/g of a unit derived from salicylic acid, based on the results of measuring the hydroxyl value.

Synthesis Example 3 of a PB Resin (PB-3)

Production of Polyester P-3: 70.0 Parts of a 2.2 mole adduct of bisphenol A-propylene oxide, 26.0 parts of terephthalic acid, 4.0 parts of fumaric acid, and 0.005 parts of dibutyltin oxide were added into a four-necked flask. A thermometer, stirring rod, condenser, and nitrogen inlet tube were attached to the flask, and then the mixture was reacted at 220° C. for 5 hours under a nitrogen atmosphere to obtain polyester resin P-3. The hydroxyl value of this polyester resin P-3 was measured to be 6.5 mgKOH/g.

A reaction vessel equipped with a stirrer, a condenser, a thermometer, and a nitrogen inlet tube was charged with 200 parts of xylene, which was then refluxed under a nitrogen flow. 70 Parts of the above-produced polyester resin P-3 was added into the mixture, and dissolved.

Next, 9.0 parts of 5-vinylsalicylic acid, 18.0 parts of styrene, 3.0 parts of n-butyl acrylate, and 1.5 parts of dimethyl-2,2'-azobis(2-methylpropionate) were mixed. The resultant mixture was added into the reaction vessel while stirring, and then held for 10 hours. Subsequently, the solvent was removed by distillation, and the resultant product was dried at 40° C. under reduced pressure to obtain resin PB-3.

Since the obtained resin PB-3 had a hydroxyl value of 34.4 mgKOH/g, it was confirmed based on the difference in the hydroxyl value with the P-3 resin that the resin PB-3 had a hydroxyl value of 27.9 mgKOH/g, specifically, that the resin PB-3 contained 498 μmol/g of a unit derived from salicylic acid.

Synthesis Example 4 of a PB Resin (PB-4)

A reaction tank equipped with a condenser, a stirrer, a thermometer, and a nitrogen inlet tube was charged with 77 parts of the polyester resin P-2 and 23 parts of 4-amino salicylic acid, then charged with 270 parts of pyridine. The resultant mixture was stirred, then charged with 96 parts of triphenyl phosphite, and heated at 120° C. for 6 hours. After the reaction finished, the mixture was reprecipitated in 360 parts of ethanol, and recovered. The obtained polymer was washed twice using 140 parts of 1 N hydrochloric acid then washed twice using 140 parts of water, and dried under reduced pressure. The hydroxyl value of the obtained resin PB-4 was 32.0 mgKOH/g. Considering that the hydroxyl value of the P-2 resin was 4.8 mgKOH/g, it was confirmed that the amount of units derived from salicylic acid added by the addition reaction was 27.2 mgKOH/g, specifically, 484 μmol/g.

Synthesis Example 5 of a PB Resin (PB-5)

Resin PB-5 was obtained by performing resin PB synthesis in the same manner as in the PB Resin Synthesis Example 1, except that the 5-vinylsalicylic acid was changed to 4-vinylsalicylic acid. The obtained resin PB-5 was confirmed to have a hydroxyl value of 29.9 mgKOH/g, specifically, contain 533 μmol/g of a unit derived from salicylic acid, based on the results of measuring the hydroxyl value.

Synthesis Example 6 of a PB Resin (PB-6)

Resin PB-6 was obtained by performing resin PB synthesis in the same manner as in the PB Resin Synthesis Example 1, except that the 5-vinylsalicylic acid was changed to 6-vinyl-salicylic acid. The obtained resin PB-6 was confirmed to have a hydroxyl value of 29.2 mgKOH/g, specifically, contain 521 μmol/g of a unit derived from salicylic acid, based on the results of measuring the hydroxyl value.

Next, the toners A to K, Q and R according to the present invention were produced based on the methods illustrated below.

Example 1

Production of Polyester P-4: 67.6 parts of a 2.2 mole adduct of bisphenol A-propylene oxide, 30.5 parts of terephthalic acid, 1.9 parts of trimellitic anhydride, and 0.005 parts of dibutyltin oxide were added into a four-necked glass flask. A thermometer, stirring rod, condenser, and nitrogen inlet tube were attached to the flask, which was then placed in a mantle heater. The mixture was reacted at 220° C. for 5 hours under a nitrogen atmosphere to obtain polyester resin P-4. The obtained resin had a molecular weight Mw=14,500.

Production of Pigment Dispersion Paste:

80.0 parts of styrene monomer 13.0 parts of Cu phthalocyanine (Pigment Blue 15:3)

4.0 parts of the resin PA-1

3.6 parts of the resin PB-1

The above-described materials were thoroughly pre-mixed in the vessel, then dispersed for about 4 hours by a bead mill while the temperature was maintained at 20° C. or less to produce a pigment dispersion paste.

Toner Particle Production: 390 parts of aqueous 0.1 mol/l $Na_3PO_4$ was added into 1,150 parts of ion-exchange water. The resultant mixtur$_e$ w$_a$s heated to 60° C., then stirred at 13,000 rpm using a Clearmix (manufactured by M Technique Co., Ltd.). Then, 58 parts of aqueous 1.0 mol/l $CaCl_2$ was added into the mixture to obtain a dispersion me$_d$ium containing $Ca_3(PO_4)_2$.

46.5 of the abov$_e$ pi$_g$m$_e$nt dispersion paste 42.0 parts of styrene monomer 18.0 parts of n-butyl acrylate 13.0 parts of ester wax (main component $C_{19}H_{39}COOC_{20}H_{41}$, melting point 68.6° C.)

5.0 parts of polyester resin P-4

These materials were heated to 60° C. to dissolve and disperse, thereby forming a monomer mixture. Further, while maintaining at 60° C., 3.0 parts of 2,2'-azobis(2,4-dimethylvaleronitrile) was added as a polymerization initiator to dissolve and prepare a monomer composition. This monomer composition was added into the above-described dispersion medium. The resultant mixture was stirred under nitrogen atmosphere at 60° C. for 15 minutes at 13,000 rpm using the Clearmix to granulate the monomer composition. Subsequently, while stirring with a paddle stirring blade, the granulated monomer composition was reacted for 5 hours at 60° C., and then stirred for 5 hours at 80° C. to finish polymerization. The composition was cooled to room temperature, charged with hydrochloric acid to dissolve the $Ca_3(PO_4)_2$, and filtered, washed with water, and dried to obtain toner particles. The obtained toner particles were further classified to obtain the desired toner particles. The obtained toner particles were used to obtain a toner by externally adding hydrophobic silica by the following operation. Specifically, 1.0 part of a hydrophobic silica fine powder, which had a number average primary particle size of 9 nm and a BET specific surface area of 180 $m^2/g$, and whose surface had been treated with hexamethyldisilazane then treated with silicone oil, and 100 parts of toner particles were mixed and externally added using a Henschel mixer (manufactured by Mitsui Miike Engineering Corporated)). The obtained toner A had a weight average particle size (D4) of 6.1 μm. The characteristics of the toners obtained below are shown in Table 2. Further, toner A was evaluated in the following manner. The evaluation results are shown in Table 3.

<Evaluation of Toner Charge Amount Rise Characteristic>

A two-component developer was produced as follows.

(Carrier Production)

A lipophilization treatment of a magnetite powder having a number average particle size of 0.25 μm and a hematite powder having a number average particle size of 0.60 μm was carried out in the following manner. Specifically, a 4.0% by mass silane coupling agent (3-(2-aminoethylaminopropyl) trimethoxysilane) was mixed, and then in the vessel the mixture was subjected to high-speed mixing and stirring at 100° C. or more.

10 parts of phenol 6 parts of a formaldehyde solution (40% formaldehyde, 10% methanol, 50% water)

63 parts of lipophilization treated magnetite 21 parts of lipophilization treated hematite The above materials, 5 parts of 28% ammonia water, and 10 parts of water were added into a flask. While stirring and mixing the mixture, the temperature was increased to 85° C. in 30 minutes. While holding at that temperature, a polymerization reaction was carried out for 3 hours, whereby the resultant product was cured. Subsequently, the product was cooled to 30° C., and water was further added thereto. The supernatant was removed, and the precipitate was washed with water and air dried. Next, the product was dried at 60° C. under reduced pressure (5 mmHg or less) to obtain spherical magnetic resin particles having a magnetic material dispersed therein.

As a coating resin, a copolymer (copolymer ratio: 8:1, weight average molecular weight 45,000) of methyl methacrylate and methyl methacrylate having a perfluoroalkyl group (m=7) was used. 10 parts of melamine particles having a particle size of 290 nm, and 6 parts of carbon particles having a specific resistance $1\times10^{-2}$ Ω·cm and a particle size of 30 nm were added into 100 parts of this coating resin, and the resultant mixture was dispersed by an ultrasonic disperser for 30 minutes. Further, a mixed solvent coating solution (solution concentration 10% by mass) of methyl ethyl ketone and toluene was produced so that the coating resin was 2.5 parts based on the carrier core.

This coating solution was resin-coated onto the surface of the magnetic resin particles by volatilizing the solvent at 70° C. while continuously applying a shear stress. The resin-coated magnetic carrier particles were heat treatment while stirring for 2 hours at 100° C., then cooled and crushed. Subsequently, the particles were classified using a 200 mesh sieve to obtain a carrier having a number average particle size of 33 μm, a true specific gravity of 3.53 $g/cm^3$, an apparent specific gravity of 1.84 $g/cm^3$, and an intensity of magnetization of 42 $Am^2/kg$.

(Production of Two-Component Developer)

Sample adjustment was performed in the following manner in order to measure the charge amount rise characteristic. A plastic bottle provided with a cap was charged with 276 g of the obtained carrier and 24 g of evaluation toner, and shaken by a shaker (YS-LD, manufactured by Yayoi Chemical Industry, Co., Ltd.) for 1 minute at a speed of 4 reciprocations per second.

<Evaluation of Toner Charge Distribution>

Using a charge distribution analyzer (manufactured by Hosokawa Micron Corporation; Model Espert Analyzer EST-3), the spread of the charge distribution was evaluated based on the obtained q/d distribution. 270 g of two-component developer was collected, and left for 3 days and nights under an ordinary-temperature ordinary-humidity environment (23° C./60% RH). The two-component developer was fed into the development unit of the color laser copier CLC 5000 (manufactured by Canon Inc.). The charge distribution of the two-component developer was measured after being rotated for 3 minutes (initial) and after being rotated for a further 60 minutes (after air rotation) by a blank rotator equipped with an external motor. The two measured values were compared. The evaluation criteria were as follows.

A Rank: As illustrated in FIG. 1, cases in which peak value did not change much between after 3 minutes of blank rotation and after 60 minutes of blank rotation, and in which toner amount charged on the + side was low.

Figure 2:
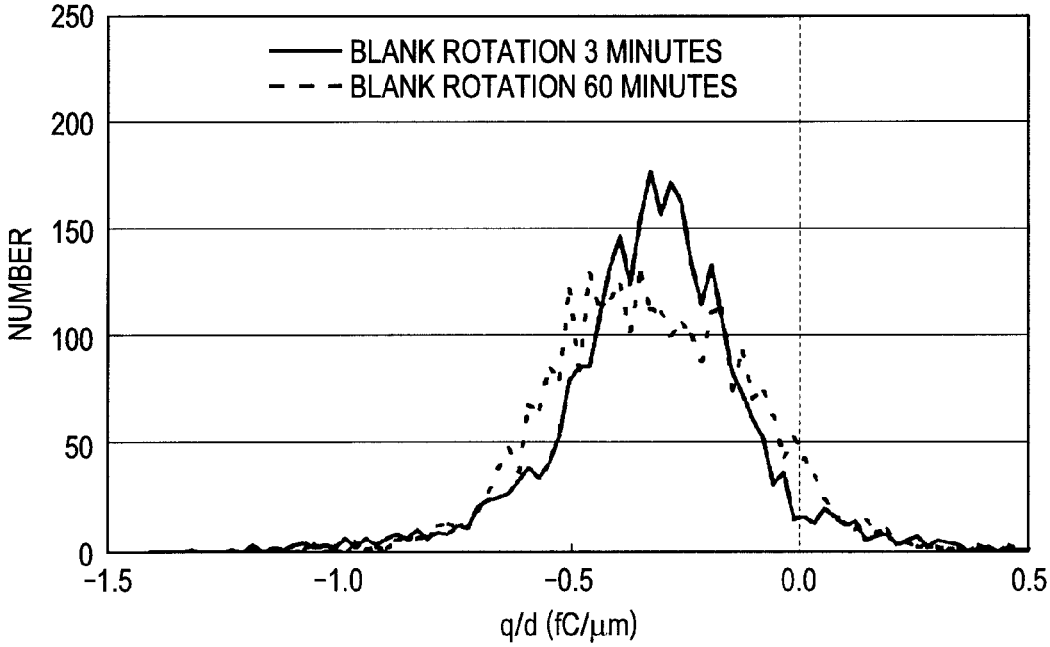
FIG. 2 is a graph illustrating changes in charge distribution, which serves as B rank evaluation criteria for evaluation of the toner charge distribution.

B Rank: As illustrated in FIG. 2, cases in which peak value did not change much, but distribution width tended to spread.

Figure 3:
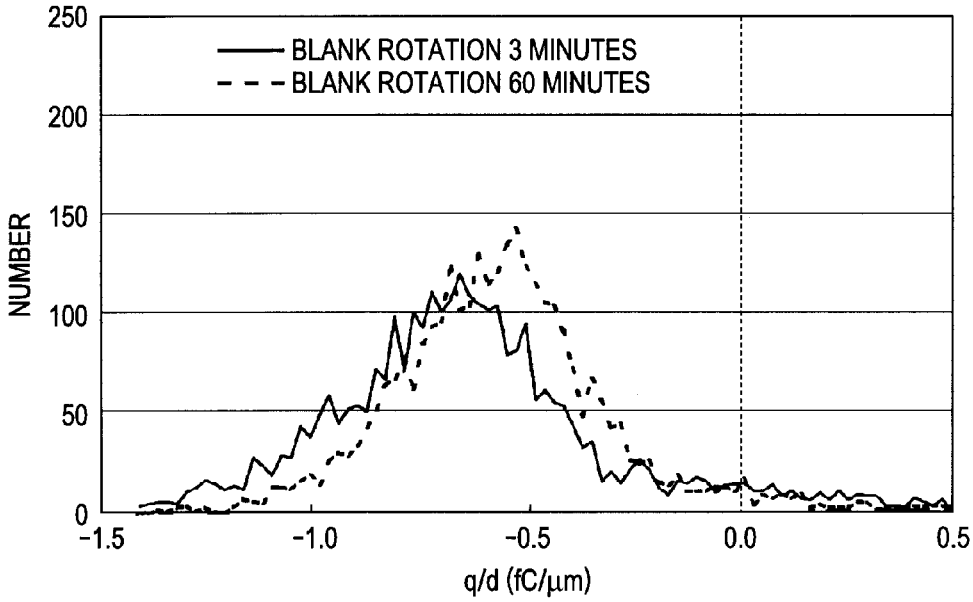
FIG. 3 is a graph illustrating changes in charge distribution trend, which serves as C rank evaluation criteria for evaluation of the toner charge distribution.

C Rank: As illustrated in FIG. 3, cases in which peak value tended to change.

Figure 4:
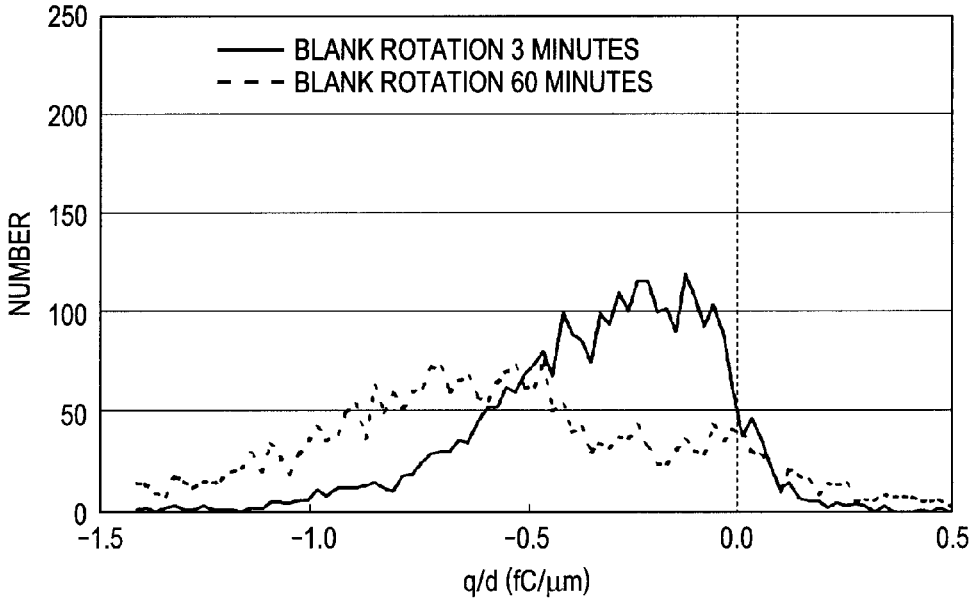
FIG. 4 is a graph illustrating changes in charge distribution trend, which serves as D rank evaluation criteria for evaluation of the toner charge distribution.

D Rank: As illustrated in FIG. 4, cases in which there was a large change between the initial and after air rotation peak values, and the toner amount charged on the + side greatly increased.

<Evaluation of Pigment Dispersion Properties>

To evaluate the pigment dispersion characteristics of the obtained toner, an ultra-thin toner specimen was produced using a microtome, and observed with a transmission electron microscope (TEM). The specimen was stained as necessary with ruthenium oxide, osmic acid, and the like. Although the evaluation criteria depend on the pigment, the evaluation was carried out by observing whether the pigment was dispersed as a primary particle size, whether there was no segregation of the pigment, and whether the pigment protruded onto the toner surface layer, and ranking the pigment based on the following criteria.

A Rank: Pigment was dispersed in a primary particle size, and uniformly presented over the whole toner.

B Rank: Pigment was nonuniformly present, with portions in which pigment had aggregated present.

C Rank: Pigment had aggregated, and frequently observed as protruding onto toner surface.

<Evaluation of Halftone Reproducibility>

The above two-component developer and the color laser copier CLC 5000 (manufactured by Canon Inc.) were used for evaluation. A fixed image was formed on a sheet of paper (color laser copier paper TKCLA 4, manufactured by Canon Inc.) while varying the load over 7 levels. The toner loads were 0.10 mg/cm$^2$, 0.20 mg/cm$^2$, 0.30 mg/cm$^2$, 0.40 mg/cm$^2$, 0.50 mg/cm$^2$, 0.60 mg/cm$^2$, and 0.70 mg/cm$^2$.

(Evaluation of Color Toner)

The CIE a* and b* of each fixed image of color toner was measured using a Spectroscan manufactured by Gretag Macbeth (measurement conditions: D65, field angle) 2°. The relationship between c* and L* was determined by plotting the chromaticity for the 7 load levels and drawing a curve that smoothly linking each of the plots. Based on this relationship, the value of c* where L*=70 and the value of L* where c*=50 were determined. Further, the value of c* is determined by $C^*=((a^*)^2+(b^*)^2)^{1/2}$.

A Rank: The value of c* is 35.0 or more when L*=70, and the value of L* is 65.0 or more when c*=50 (image chroma is excellent).

B Rank: The value of c* is 30.0 or more when L*=70, and the value of L* is 60.0 or more when c*=50 (a good image, but color reproducibility is narrowed).

C Rank: The value of c* is less than 30.0 when L*=70, or the value of L* is less than 60.0 when c*=50 (poor color reproducibility).

(Evaluation of Black Toner)

The same fixed image as for the color toner was produced as described above. The image density for each fixed image of the black toner was measured by a Macbeth reflection densitometer (manufactured by Macbeth).

(Evaluation Criteria of Black Toner)

Evaluation was carried out as described below based on the ratio of the difference (D0.4−D0.3) between the image density at a load of 0.30 mg/cm$^2$ and 0.40 mg/cm$^2$ and the image density (D0.7) at a load of 0.70 mg/cm$^2$.

A Rank: $1.30 \leq (D0.4-D0.3)/(D0.7)$

B Rank: $1.10 \leq (D0.4-D0.3)/(D0.7) < 1.30$

C Rank: $(D0.4-D0.3)/(D0.7) < 1.10$

Example 2

Toner B was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of Cu phthalocyanine (Pigment Blue 15:3)
4.0 parts of the resin PA-1
0.55 parts of the resin PB-1

Example 3

Toner C was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of Cu phthalocyanine (Pigment Blue 15:3)
4.0 parts of the resin PA-2
17.5 parts of the resin PB-1

Example 4

Toner D was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of Cu phthalocyanine (Pigment Blue 15:3)
4.0 parts of the resin PA-2
2.0 parts of the resin PB-1

Example 5

Toner E was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of Cu phthalocyanine (Pigment Blue 15:3)

4.0 parts of the resin PA-3
3.8 parts of the resin PB-1

Example 6

Toner F was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of Cu phthalocyanine (Pigment Blue 15:3)
2.0 parts of the resin PA-4
1.15 parts of the resin PB-2

Example 7

Toner G was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of Cu phthalocyanine (Pigment Blue 15:3)
8.0 parts of the resin PA-5
8.5 parts of the resin PB-3

Example 8

Toner H was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

78.0 parts of styrene monomer
15.0 parts of carbon black
4.0 parts of the resin PA-1
3.6 parts of the resin PB-1

Example 9

Toner I was obtained by producing a toner in the same manner as in Example 1, except that the materials used in the production of the pigment dispersion paste of Example 1 were changed to the following. The characteristics of the obtained toner are shown in Table 2. Further, the toner was evaluated in the same manner as in Example 1. The evaluation results are shown in Table 3.

80.0 parts of styrene monomer
13.0 parts of quinacridone (Pigment Violet 19)
4.0 parts of the resin PA-1
3.6 parts of the resin PB-1

Example 10

<Production Example of Binder Resin>

Production of Polyester P-5: 1,206 parts of a 2.2 mole adduct of bisphenol A-propylene oxide, 475 parts of a 2.2 mole adduct of bisphenol A-ethylene oxide, 249 parts of terephthalic acid, 192 parts of trimellitic anhydride, 290 parts of fumaric acid, and 0.1 parts of dibutyltin oxide were added into a 4-liter, four-necked glass flask. A thermometer, stirring rod, condenser, and nitrogen inlet tube were attached to the flask, which was then placed in a mantle heater. The mixture was reacted at 220° C. for 5 hours under a nitrogen atmosphere to obtain polyester resin P-5. The obtained resin had a molecular weight Mw=21,500, and Mn=3,400.

Next, 100.0 parts of the resin P-5, 4.0 parts of the resin PA-6, 4.0 parts of the resin PB-3, 5.0 parts of Cu phthalocyanine (Pigment Blue 15:3), and 3.0 parts of paraffin wax (HNP-7: manufactured by Nippon Seiro Co., Ltd.) were thoroughly pre-mixed using a Henschel mixer (manufactured by Mitsui Miike Engineering Corporated). The resultant mixture was then melt-kneaded with a twin-screw extruder, and cooled. The cooled mixture was then coarsely pulverized using a hammer mill to a particle size of about 1 mm to 2 mm. Next, the coarsely pulverized product was finely pulverized by a fine pulverizer using an air jet technique. Further, the obtained finely pulverized product was classified using a multifraction classifying apparatus to obtain toner particles.

Toner J was obtained by externally adding 1.0 part of a hydrophobic silica fine powder having a BET of 200 $m^2$ to 100 parts of the above-described toner resin particles using a Henschel mixer. The characteristics of the obtained toner are shown in Table 2. Further, the toner was evaluated in the same manner as in Example 1. The evaluation results are shown in Table 3.

Example 11

Toner K was obtained by producing a toner in the same manner as in Example 10, except that the type and the added amount of the PA resin and the PB resin in Example 10 were changed to the following. The characteristics of the obtained toner are shown in Table 2. Further, the toner was evaluated in the same manner as in Example 1. The evaluation results are shown in Table 3.

4.0 parts of the resin PA-7
4.0 parts of the resin PB-4

Example 12

Toner Q was obtained by producing a toner in the same manner as in Example 1, except that in the production of the pigment dispersion paste of Example 1, the resin PB-1 was changed to the resin PB-5. The characteristics of the obtained toner are shown in Table 2. Further, the toner was evaluated in the same manner as in Example 1. The evaluation results are shown in Table 3.

Example 13

Toner R was obtained by producing a toner in the same manner as in Example 1, except that in the production of the pigment dispersion paste of Example 1, the resin PB-1 was changed to the resin PB-6. The characteristics of the obtained toner are shown in Table 2. Further, the toner was evaluated in the same manner as in Example 1. The evaluation results are shown in Table 3.

Comparative Examples 1 to 5

Toners L to P were obtained by producing a toner in the same manner as in Example 10, except that the mixing ratio of the resin PA and PB in Example 10 were changed to those shown in Table 2. The characteristics of the obtained toner are shown in Table 2. Further, the toner was evaluated in the same manner as in Example 1. The evaluation results are shown in Table 3.

TABLE 1-1

| | Composition of Produced Resin | | | | | | | | | |
|---|---|---|---|---|---|---|---|---|---|---|
| | | | | | | Polyester Component | | | | |
| | Vinyl Resin Component | | | | | Polyester Resin Component (charged amount: parts by mass) | | | | |
| | Vinyl Resin Monomer Component (charged amount: parts by mass) | | | | Content | Polyhydric | Polyvalent | Addition Reaction Compound | | Content |
| No. | Unit A Component | Unit B Component | Styrene | Other | rate (wt %) | Alcohol Component | Carboxylic Component | Unit A Component | Unit B Component | rate (wt %) |
| PA-1 | 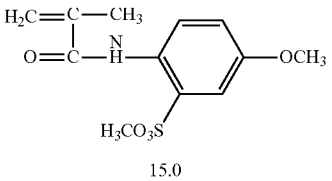 15.0 | — | 69.0 | 2-EHA 16.0 | 100 | — | — | — | — | — |
| PA-2 | 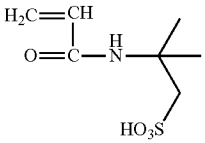 6.0 | — | 78.0 | ↑ 16.0 | 100 | — | — | — | — | — |
| PA-3 | 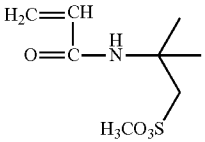 12.0 | — | 72.0 | ↑ 16.0 | 100 | — | — | — | — | — |
| PA-4 | 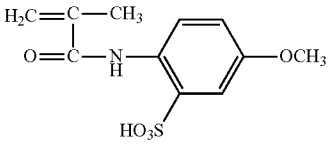 8.0 | — | 76.0 | ↑ 16.0 | 100 | — | — | — | — | — |

TABLE 1-1-continued

| | Composition of Produced Resin | | | | | | | | | |
|---|---|---|---|---|---|---|---|---|---|---|
| | Vinyl Resin Component | | | | | Polyester Component | | | | |
| | Vinyl Resin Monomer Component (charged amount: parts by mass) | | | | | Polyester Resin Component (charged amount: parts by mass) | | | | |
| No. | Unit A Component | Unit B Component | Styrene | Other | Content rate (wt %) | Polyhydric Alcohol Component | Polyvalent Carboxylic Component | Addition Reaction Compound Unit A Component | Addition Reaction Compound Unit B Component | Content rate (wt %) |
| PA-5 | 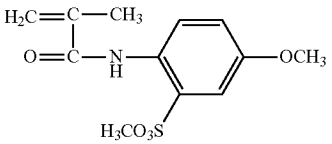 16.0 | — | 74.0 | n-Ba 10.0 | 100 | — | — | — | — | — |
| PA-6 | 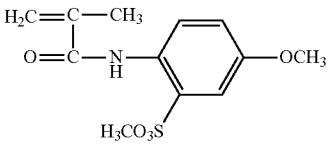 50.0 | — | 50.0 | — | 30 | BPA(PO) 69.0 | TPA/FMA 28.0/3.0 | — | — | 70 |
| PA-7 | — | — | — | — | — | BPA(PO) 67.8 | TPA/TMA 22.2/10.0 | 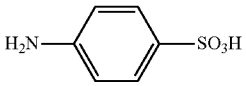 | — | 100 |
| PB-1 | — | 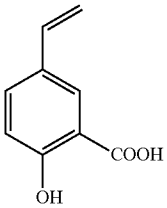 9.0 | 75.0 | 2-EHA 16.0 | 100 | — | — | — | — | — |

TABLE 1-1-continued

| | Composition of Produced Resin | | | | | | | | | |
|---|---|---|---|---|---|---|---|---|---|---|
| | Vinyl Resin Component | | | | | Polyester Component | | | | |
| | Vinyl Resin Monomer Component (charged amount: parts by mass) | | | | | Polyester Resin Component (charged amount: parts by mass) | | | | |
| No. | Unit A Component | Unit B Component | Styrene | Other | Content rate (wt %) | Polyhydric Alcohol Component | Polyvalent Carboxylic Component | Addition Reaction Compound Unit A Component | Addition Reaction Compound Unit B Component | Content rate (wt %) |
| PB-2 | — | 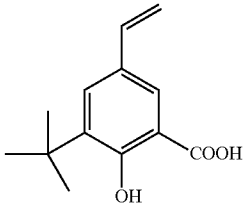 12.0 | 72.0 | ↑ 16.0 | 100 | — | — | — | — | — |
| PB-3 | — | 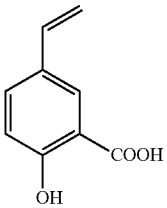 30.0 | 60.0 | n-Ba 10.0 | 30 | BPA(PO) 70.0 | TPA/FMA 26.0/4.0 | — | — | 70 |
| PB-4 | — | — | — | — | — | BPA(PO) 67.8 | TPA/TMA 22.2/10.0 | — | 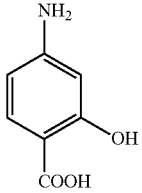 | 100 |

TABLE 1-1-continued

| | Composition of Produced Resin | | | | | | | | | |
|---|---|---|---|---|---|---|---|---|---|---|
| | Vinyl Resin Component | | | | | Polyester Component | | | | |
| | Vinyl Resin Monomer Component (charged amount: parts by mass) | | | | | Polyester Resin Component (charged amount: parts by mass) | | | | |
| No. | Unit A Component | Unit B Component | Styrene | Other | Content rate (wt %) | Polyhydric Alcohol Component | Polyvalent Carboxylic Component | Addition Reaction Compound Unit A Component | Addition Reaction Compound Unit B Component | Content rate (wt %) |
| PB-5 | — | 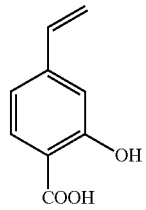 9.2 | 74.8 | 2-EHA 16.0 | 100 | — | — | — | — | — |
| PB-6 | — | 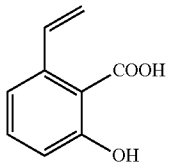 8.8 | 75.2 | ↑ 16.0 | 100 | — | — | — | — | — |

TABLE 1-2

| No. | Characteristics of Produced Resin: S Amount in Resin (wt %) | Unit A Content (μmol/g) | Hydroxyl Value Derived from the unit B in Resin (mgK OH/g) | Unit B Content (μmol/g) | Molecular Weight Mw/Mn |
|---|---|---|---|---|---|
| PA-1 | 1.571 | 490 | — | — | 16400/7800 |
| PA-2 | 0.843 | 263 | — | — | 18500/7100 |
| PA-3 | 1.674 | 522 | — | — | 14900/6900 |
| PA-4 | 0.930 | 290 | — | — | 19000/8200 |
| PA-5 | 1.728 | 539 | — | — | 12300/6600 |
| PA-6 | 1.610 | 502 | — | — | 9700/4700 |
| PA-7 | 1.526 | 476 | — | — | 11000/4500 |
| PB-1 | — | — | 30.3 | 540 | 15500/8600 |

TABLE 1-2-continued

| No. | Characteristics of Produced Resin: S Amount in Resin (wt %) | Unit A Content (μmol/g) | Hydroxyl Value Derived from the unit B in Resin (mgK OH/g) | Unit B Content (μmol/g) | Molecular Weight Mw/Mn |
|---|---|---|---|---|---|
| PB-2 | — | — | 28.7 | 511 | 12900/8900 |
| PB-3 | — | — | 27.9 (34.4*) | 498 | 11500/4900 |
| PB-4 | — | — | 27.2 (32.0*) | 484 | 12100/5600 |
| PB-5 | — | — | 29.9 | 533 | 14700/8500 |
| PB-6 | | | 29.2 | 521 | 16900/8800 |

*Including hydroxyl value derived from raw materials of PB resin.

TABLE 2

| | | Master Batch (charged amount: parts by mass) | | | | | | | Internal Addition Formulation (parts by mass) | | | | | |
|---|---|---|---|---|---|---|---|---|---|---|---|---|---|---|
| | | | Pigment | | PA Resin | | PB Resin | | | | | | Polyester Resin | |
| | | Styrene | Type | Charged Amount | Type | Charged Amount | Type | Charged Amount | Master Batch | Styrene | BA | Wax | Type | Charged Amount |
| Example 1 | Toner A | 80.0 | C.I. Pig. Blue 15:3 | 13.0 | PA-1 | 4.0 | PB-1 | 3.6 | 46.5 | 42.0 | 18.0 | 13.0 | P-4 | 5.0 |
| Example 2 | Toner B | 80.0 | ↑ | 13.0 | ↑ | 4.0 | ↑ | 0.55 | 46.5 | 42.0 | 18.0 | 13.0 | ↑ | 5.0 |
| Example 3 | Toner C | 80.0 | ↑ | 13.0 | PA-2 | 4.0 | ↑ | 17.5 | 46.5 | 42.0 | 18.0 | 13.0 | ↑ | 5.0 |
| Example 4 | Toner D | 80.0 | ↑ | 13.0 | ↑ | 4.0 | ↑ | 2.0 | 46.5 | 42.0 | 18.0 | 13.0 | ↑ | 5.0 |
| Example 5 | Toner E | 80.0 | ↑ | 13.0 | PA-3 | 4.0 | ↑ | 3.8 | 46.5 | 42.0 | 18.0 | 13.0 | ↑ | 5.0 |
| Example 6 | Toner F | 80.0 | ↑ | 13.0 | PA-4 | 2.0 | PB-2 | 1.15 | 46.5 | 42.0 | 18.0 | 13.0 | ↑ | 5.0 |
| Example 7 | Toner G | 80.0 | ↑ | 13.0 | PA-5 | 8.0 | PB-3 | 8.5 | 46.5 | 42.0 | 18.0 | 13.0 | ↑ | 5.0 |
| Example 8 | Toner H | 78.0 | CB | 15.0 | PA-1 | 4.0 | PB-1 | 3.6 | 46.5 | 42.0 | 18.0 | 13.0 | ↑ | 5.0 |
| Example 9 | Toner I | 80.0 | C.I. Pig. Violet 19 | 13.0 | ↑ | 4.0 | ↑ | 3.6 | 46.5 | 42.0 | 18.0 | 13.0 | ↑ | 5.0 |
| Example 10 | Toner J | 0.0 | C.I. Pig. Blue 15:3 | 5.0 | PA-6 | 4.0 | PB-3 | 4.0 | 0.0 | 0.0 | 0.0 | 3.0 | P-5 | 100.0 |
| Example 11 | Toner K | 0.0 | ↑ | 5.0 | PA-7 | 4.0 | PB-4 | 4.0 | 0.0 | 0.0 | 0.0 | 3.0 | ↑ | 100.0 |
| Example 12 | Toner Q | 80.0 | C.I. Pig. Blue 15:3 | 13.0 | PA-1 | 4.0 | PB-5 | 4.0 | 46.5 | 42.0 | 18.0 | 13.0 | P-4 | 5.0 |
| Example 13 | Toner R | 80.0 | ↑ | 13.0 | ↑ | 4.0 | PB-6 | 4.0 | 46.5 | 42.0 | 18.0 | 13.0 | ↑ | 5.0 |
| Comparative Example 1 | Toner L | 0.0 | ↑ | 5.0 | PA-4 | 0.6 | PB-2 | 0.3 | 0.0 | 0.0 | 0.0 | 3.0 | P-5 | 100.0 |
| Comparative Example 2 | Toner M | 0.0 | ↑ | 5.0 | ↑ | 2.0 | ↑ | 13.5 | 0.0 | 0.0 | 0.0 | 3.0 | ↑ | 100.0 |
| Comparative Example 3 | Toner N | 0.0 | ↑ | 5.0 | PA-5 | 1.6 | PB-3 | 0.1 | 0.0 | 0.0 | 0.0 | 3.0 | ↑ | 100.0 |
| Comparative Example 4 | Toner O | 0.0 | ↑ | 5.0 | ↑ | 1.6 | — | 0.0 | 0.0 | 0.0 | 0.0 | 3.0 | ↑ | 100.0 |
| Comparative Example 5 | Toner P | 0.0 | ↑ | 5.0 | — | 0.0 | PB-1 | 3.6 | 0.0 | 0.0 | 0.0 | 3.0 | ↑ | 100.0 |

| | | Internal Addition Formulation (parts by mass): Initiator | Total | Toner Particle Added Ratio: Added Ratio of PA Resin (wt %) | Added Ratio of PB Resin (wt %) | Toner Particle Unit Content: Content a (μmol/g) | Content b (μmol/g) | Molar Ratio of Units B and A (b/a) | Toner Particle Characteristics Particle Size Distribution: Weight Average Particle Size (D4) | D4/Dn |
|---|---|---|---|---|---|---|---|---|---|---|
| Example 1 | Toner A | 3.0 | 127.5 | 1.45 | 1.31 | 7.11 | 7.05 | 0.99 | 6.1 | 1.16 |
| Example 2 | Toner B | 3.0 | 127.5 | 1.50 | 0.21 | 7.33 | 1.11 | 0.15 | 5.8 | 1.18 |
| Example 3 | Toner C | 3.0 | 127.5 | 1.27 | 5.57 | 3.35 | 30.10 | 8.98 | 5.8 | 1.20 |
| Example 4 | Toner D | 3.0 | 127.5 | 1.47 | 0.74 | 3.88 | 3.98 | 1.03 | 6.0 | 1.17 |
| Example 5 | Toner E | 3.0 | 127.5 | 1.45 | 1.37 | 7.55 | 7.42 | 0.98 | 6.2 | 1.15 |
| Example 6 | Toner F | 3.0 | 127.5 | 0.76 | 0.44 | 2.20 | 2.23 | 1.01 | 6.4 | 1.18 |
| Example 7 | Toner G | 3.0 | 127.5 | 2.66 | 2.83 | 14.36 | 14.10 | 0.98 | 6.2 | 1.19 |
| Example 8 | Toner H | 3.0 | 127.5 | 1.45 | 1.31 | 7.11 | 7.05 | 0.99 | 6.6 | 1.19 |
| Example 9 | Toner I | 3.0 | 127.5 | 1.45 | 1.31 | 7.11 | 7.05 | 0.99 | 6.1 | 1.16 |
| Example 10 | Toner J | 0.0 | 116.0 | 3.45 | 3.45 | 17.3 | 17.17 | 0.99 | 7.3 | 1.22 |

TABLE 2-continued

| | | | | | | | | | | |
|---|---|---|---|---|---|---|---|---|---|---|
| Example 11 | Toner K | 0.0 | 116.0 | 3.45 | 3.45 | 16.4 | 16.69 | 1.02 | 7.4 | 1.23 |
| Example 12 | Toner Q | 3.0 | 127.5 | 1.44 | 1.44 | 7.08 | 7.70 | 1.09 | 6.0 | 1.18 |
| Example 13 | Toner R | 3.0 | 127.5 | 1.44 | 1.44 | 7.08 | 7.53 | 1.06 | 6.1 | 1.17 |
| Comparative Example 1 | Toner L | 0.0 | 108.85 | 0.51 | 0.28 | 1.47 | 1.41 | 0.96 | 7.8 | 1.21 |
| Comparative Example 2 | Toner M | 0.0 | 123.5 | 1.62 | 10.93 | 4.70 | 55.86 | 11.89 | 7.3 | 1.20 |
| Comparative Example 3 | Toner N | 0.0 | 109.7 | 1.46 | 0.09 | 7.86 | 0.45 | 0.06 | 7.5 | 1.18 |
| Comparative Example 4 | Toner O | 0.0 | 109.6 | 1.46 | 0.00 | 7.87 | 0.00 | 0.00 | 7.2 | 1.22 |
| Comparative Example 5 | Toner P | 0.0 | 111.6 | 0.00 | 3.23 | 0.00 | 17.42 | ∞ | 7.0 | 1.19 |

TABLE 3

| | Evaluation Toner | Charge distribution | Pigment Dispersion Properties | Halftone Reproducibility |
|---|---|---|---|---|
| Example 1 | Toner A | A | A | A |
| Example 2 | Toner B | B | B | B |
| Example 3 | Toner C | C | A | A |
| Example 4 | Toner D | C | B | A |
| Example 5 | Toner E | B | A | A |
| Example 6 | Toner F | B | A | A |
| Example 7 | Toner G | A | A | A |
| Example 8 | Toner H | A | A | A |
| Example 9 | Toner I | A | A | A |
| Example 10 | Toner J | B | B | B |
| Example 11 | Toner K | C | B | B |
| Example 12 | Toner Q | B | A | A |
| Example 13 | Toner R | B | B | A |
| Comparative Example 1 | Toner L | D | B | B |
| Comparative Example 2 | Toner M | C | C | C |
| Comparative Example 3 | Toner N | C | B | C |
| Comparative Example 4 | Toner O | C | C | C |
| Comparative Example 5 | Toner P | D | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-297289, filed Dec. 28, 2009, which is hereby incorporated by reference herein in its entirety.

What is claimed is:

1. A toner comprising a toner particle containing a binder resin, a colorant, a resin PA, and a resin PB, wherein the resin PA and the resin PB each independently represents at least one resin selected from the group consisting of a vinyl polymer and a hybrid resin formed by binding a vinyl polymer and a polyester resin each other, wherein the combination of the resin PA and the resin PB is selected from the group consisting of the following (i) to (v):

(i) the resin PA having a unit A represented by the following formula (1-a) and the resin PB having a unit B represented by the following formula (2-a);

(ii) the resin PA having a unit A represented by the following formula (1-b) and the resin PB having a unit B represented by the following formula (2-a);

(iii) the resin PA having a unit A represented by the following formula (1-c) and the resin PB having a unit B represented by the following formula (2-b);

(iv) the resin PA having a unit A represented by the following formula (1-a) and the resin PB having a unit B represented by the following formula (2-c); and (v) the resin PA having a unit A represented by the following formula (1-a), and the resin PB having a unit B represented by the following formula (2-d), and wherein a content "a" of the unit A in the toner particle is 2.00 μmol/g or more, and a molar ratio b/a of the content "a" and a content "b" of the unit B in the toner particle is 0.10 or more and 10.00 or less:

(1-a)

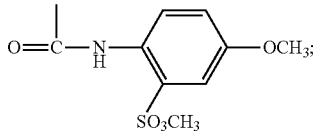

(1-b)

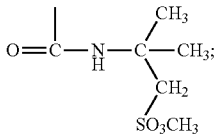

(1-c)

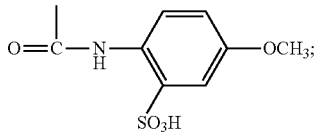

(2-a)

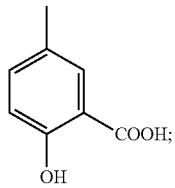

(2-b)

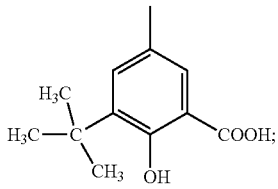

-continued
(2-c)
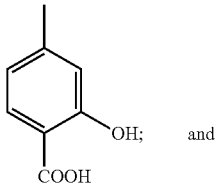
and
(2-d)
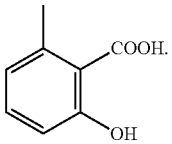
2. The toner according to claim 1, wherein the toner particle is produced in an aqueous medium.
* * * * *